US012569741B2

(12) United States Patent
Bach

(10) Patent No.: US 12,569,741 B2
(45) Date of Patent: Mar. 10, 2026

(54) ROPING PRACTICE APPARATUS

(71) Applicant: Smarty Rodeo, LLC, Mount Pleasant, TX (US)

(72) Inventor: Allen Bach, Mount Pleasant, TX (US)

(73) Assignee: SMARTY RODEO, LLC, Mount Pleasant, TX (US)

( * ) Notice: Subject to any disclaimer, the term of this patent is extended or adjusted under 35 U.S.C. 154(b) by 449 days.

(21) Appl. No.: 18/461,150

(22) Filed: Sep. 5, 2023

(65) Prior Publication Data

US 2023/0415015 A1 Dec. 28, 2023

Related U.S. Application Data

(63) Continuation-in-part of application No. 17/669,866, filed on Feb. 11, 2022, now abandoned, which is a continuation-in-part of application No. 16/820,222, filed on Mar. 16, 2020, now abandoned, which is a continuation-in-part of application No. 15/802,234, filed on Nov. 2, 2017, now Pat. No. 11,140,869.

(60) Provisional application No. 62/416,518, filed on Nov. 2, 2016.

(51) Int. Cl.
*A63B 69/00* (2006.01)
*A63B 71/06* (2006.01)

(52) U.S. Cl.
CPC ..... *A63B 69/0068* (2013.01); *A63B 71/0622* (2013.01); *A63B 2071/0694* (2013.01); *A63B 2214/00* (2020.08); *A63B 2225/74* (2020.08)

(58) Field of Classification Search
CPC ..... A63B 69/0068
See application file for complete search history.

(56) References Cited

U.S. PATENT DOCUMENTS

| | | | |
|---|---|---|---|
| 3,776,553 | A | 12/1973 | Kelton |
| 3,802,706 | A | 4/1974 | Hamm |
| 3,947,033 | A | 3/1976 | Bennett |
| 4,239,259 | A | 12/1980 | Martinez |
| 4,451,045 | A | 5/1984 | Fesmire |
| 4,640,515 | A | 2/1987 | Rhine |

(Continued)

FOREIGN PATENT DOCUMENTS

BR 112017011933 A2 * 12/2017 ..... A63B 71/0036

OTHER PUBLICATIONS

International Search Report and Written Opinion for PCT/US2017/059769 by United States Patent Office dated Jan. 12, 2018, 10 pp.

(Continued)

*Primary Examiner* — Morgan T Jordan

(57) ABSTRACT

A mechanical roping apparatus for practicing animal roping, the apparatus including: an animal assembly with leg members; one or more visual cue indicia mounted on the leg members configured to indicate to a user a proper time to rope a leg member using proper roping technique; an indicia actuation assembly with: an indicia wheel rotatably mounted on the animal assembly and in contact with the ground; and an indicia switch operably connected to the indicia wheel and to the one or more indicia, wherein the switch is configured to operate as the indicia wheel turns when the animal assembly is moved; and two, three, four or more skids positioned to the right, left, or both of a longitudinal centerline of the animal assembly.

20 Claims, 7 Drawing Sheets

(56) References Cited

U.S. PATENT DOCUMENTS

| | | | | |
|---|---|---|---|---|
| 4,874,179 | A | 10/1989 | Henderson | |
| 5,009,432 | A | 4/1991 | Richard | |
| 5,080,373 | A | 1/1992 | Jones | |
| 5,333,895 | A | 8/1994 | Fujan et al. | |
| 5,568,926 | A | 10/1996 | Kaptein | |
| 5,709,386 | A | 1/1998 | Nelson et al. | |
| 5,816,578 | A | 10/1998 | Frankamp | |
| 6,364,324 | B1 | 4/2002 | Buchanan | |
| 6,422,945 | B1 | 7/2002 | Okita et al. | |
| 6,457,757 | B2 | 10/2002 | Hendrick | |
| 6,866,594 | B2 * | 3/2005 | Greenwood | A63B 69/00 473/422 |
| 7,059,605 | B1 * | 6/2006 | Hughes | A01K 15/003 273/338 |
| 7,293,775 | B1 | 11/2007 | Donnelly | |
| 7,430,990 | B1 | 10/2008 | Copenhaver | |
| 7,861,298 | B1 | 12/2010 | Giallorenzi et al. | |
| 8,720,894 | B2 * | 5/2014 | Whitaker | A01B 49/02 273/359 |
| 8,783,689 | B1 | 7/2014 | Copenhaver | |
| 9,072,961 | B2 | 7/2015 | Stellenberg et al. | |
| 9,129,534 | B2 | 9/2015 | Payne | |
| 10,133,549 | B1 | 11/2018 | Do | |
| 10,888,760 | B1 * | 1/2021 | Cady | A63B 71/0686 |
| 2004/0108345 | A1 | 6/2004 | Oh | |
| 2004/0154854 | A1 | 8/2004 | Stephens | |
| 2006/0170163 | A1 | 8/2006 | Perkins | |
| 2009/0014960 | A1 | 1/2009 | Brackens | |
| 2012/0234565 | A1 * | 9/2012 | Kiser | A01B 63/24 172/669 |
| 2014/0076593 | A1 | 3/2014 | Whitaker | |
| 2014/0193785 | A1 | 7/2014 | McCarthy | |
| 2014/0261237 | A1 | 9/2014 | Payne | |
| 2016/0029596 | A1 | 2/2016 | Bruegman et al. | |
| 2017/0056728 | A1 * | 3/2017 | Todd | A63B 21/0615 |
| 2017/0177367 | A1 | 6/2017 | DeHon | |
| 2017/0270819 | A1 | 9/2017 | Stephens | |
| 2018/0046807 | A1 | 2/2018 | Patil et al. | |
| 2018/0116176 | A1 | 5/2018 | Bach | |
| 2020/0004453 | A1 | 1/2020 | Rori et al. | |
| 2020/0108301 | A1 * | 4/2020 | Whitaker | A63B 69/0068 |
| 2020/0360787 | A1 * | 11/2020 | Llewellyn | A63B 71/023 |
| 2022/0023733 | A1 * | 1/2022 | Hernandez | A01K 15/02 |
| 2023/0211222 | A1 * | 7/2023 | Camper | A63B 69/04 119/839 |
| 2025/0100333 | A1 * | 3/2025 | Sagers | B60D 1/065 |
| 2025/0170451 | A1 * | 5/2025 | Hladky | A01K 15/003 |
| 2025/0312671 | A1 * | 10/2025 | Johnson | A63B 24/0087 |

OTHER PUBLICATIONS

International Search Report and Written Opinion for PCT/US2021/021616 by United States Patent Office dated Apr. 22, 2021, 9 pp.

Heel-O-Matic, "HOX" roping device, http://www.heelomatic.com/product/hox/, archived Oct. 2, 2015 (Year: 2015).

* cited by examiner

ROPING PRACTICE APPARATUS

CROSS-REFERENCE TO RELATED APPLICATIONS

This application is a continuation-in-part application of U.S. patent application Ser. No. 17/669,866 filed on Feb. 11, 2022, which is a continuation-in-part application of U.S. patent application Ser. No. 16/820,222 filed on Mar. 16, 2020, which is a continuation-in-part application of U.S. patent application Ser. No. 15/802,234 filed on Nov. 2, 2017, now Issued as U.S. Pat. No. 11,140,869 on Oct. 12, 2021, which claims priority to U.S. Provisional Application Ser. No. 62/416,518, filed Nov. 2, 2016, the entire contents of which are incorporated herein by reference.

STATEMENT OF FEDERALLY FUNDED RESEARCH

None.

TECHNICAL FIELD OF THE INVENTION

The present invention relates in general to the field of roping practice devices, and more particularly, to a novel rodeo training apparatus and method for rope training with indicia that direct the user when to lasso the legs of the animal.

BACKGROUND OF THE INVENTION

Without limiting the scope of the invention, its background is described in connection with roping practice devices.

One such invention is taught in U.S. Pat. No. 3,947,033, issued to Bennett and entitled, "Steer roping training device." Briefly, this inventor teaches a mechanical device having the general appearance of a steer for use in practicing steer roping. The device consists of a base section having a pair of spaced wheels mounted at the back thereof and a body section having at least one wheel mounted at the front, and the base and body sections are interconnected so as to permit pivotal movement of the body section relative to the base section about a horizontal axis to give the body section a life-like lean attitude when roped by the horns and towed by a horse.

Another such invention is taught in U.S. Pat. No. 7,293,775, issued to Donnelly entitled "Roping practice apparatus". Briefly, this inventor teaches a roping practice apparatus that includes a simulated steer assembly for roping practice, having a base with a vertical support mechanism mounted on the base; a body mounted on the vertical support mechanism and having a front end, a back end, a left side and a right side; legs mounted on the back end of the body; a head portion mounted on the front end so that the head pivots toward the left side when roped; a rocker arm mounted on the vertical support mechanism; a spring and cable system connecting each of the legs to the rocker arm for moving the legs backward and forward; and a power source operatively connected to the rocker arm. The assembly may be towed or may be radio-controlled.

Another such invention is taught in U.S. Pat. No. 8,783,689, issued to Copenhaver and entitled, "Steer roping practice apparatus with enhanced leg roping simulation." Briefly, this inventor teaches a mechanical roping steer apparatus for practicing roping of a steer and may comprise a steer assembly having a front and a rear. The steer assembly comprised a frame and a leg assembly mounted on the frame and including at least one leg member being movable with respect to the frame, the at least one leg member having a lower end movable along an arc. The steer apparatus also comprises an actuation assembly configured to engage a ground surface below the steer assembly and move the at least one leg member when the steer assembly is moved across the ground surface. The steer apparatus may also include a rope deflection assembly configured to deflect a rope from looping about the at least one leg member for at least a forward portion of the arc of movement of the leg lower end.

Another such invention is taught in U.S. Patent Publication No. 20140193785, filed by McCarthy, and entitled "Roping Dummy Apparatus." Briefly, this applicant teaches a team roping dummy that encourages more correct roping. The dummy has a relatively compact main body with collapsible legs, removable head, and internal body storage for head. In order to aid in the rope's loop expansion and ease of removal, the legs collapse toward one another under the pressure of a tightened rope, and re-expand after rope is loosened. The back legs extend at proper angle of heel loop swing, causing the roper to match the angle of the loop during its swing to the angle of the legs and provides a visual line to match the plane of the loop. The dummy has removable and rotatable horns allowing for different horn sizes, shapes, and angles.

SUMMARY OF THE INVENTION

In one embodiment, the present invention includes a mechanical roping apparatus for practicing animal roping, the apparatus comprising: an animal assembly having a front, a rear, and a pivot that provides an up and down motion at the rear of the animal assembly to simulate a hopping motion by the animal; a leg assembly mounted at the rear of the frame and including leg members that are movable with respect to the frame to simulate a running motion; an actuation assembly configured to move the leg members from a forward position when the leg members touch the ground, during a stride such that the legs are in contact with the ground until they reach a rear facing position and the leg members are raised from the ground and kick; and the leg members are off the ground from the rear position to the front position; and one or more indicia that indicates to the user when the leg members are in an optimal position for roping. In one aspect, the indicia are selected from at least one of a visual, an auditory, or a vibrational cue. In another aspect, the indicia are an auditory or a vibrational cue that is carried by the user. In another aspect, the indicia indicates when the leg members are not in an optimal position for roping. In another aspect, the indicia is visual and is selected from a light, a colored light, an LED, an OLED, is a light that changes colors, the light traverses from the top to the bottom of a string of lights and vice versa, the lights are red and green, the light is intermittent, the light dims and intensifies, or the light pulses to indicate the correct time to rope the leg members. In another aspect, the leg members are defined further as comprising an ankle and a hock, wherein a visible indicia is positioned between the ankles and the hock, between the ankles and the rear of the animal assembly, between the hock and the rear of the animal assembly, on the rear of the animal assembly, or combinations thereof. In another aspect, the leg assembly is configured such that the lower end of at least one of the legs of the leg members contacts the ground surface for at least a portion of an arc of movement of the leg lower end in a manner that prevents a rope from looping about the at least one leg. In another aspect, at least one of the leg members comprises a foot extension member extending from the lower end of the at least one leg member for contacting the ground surface during at least a portion of the generally pivotal movement of the leg members. In another aspect, the leg members are coated or wrapped with a surface that simulates the hide of the animal. In another aspect, the indicia is turned on when the leg members are about the most rearward position and the indicia turns off at the top of the hop when the leg members are generally perpendicular to the ground. In another aspect, a hopping motion of the animal assembly, the forward and rearward movement of the leg members, or both, is driven mechanically, hydraulically, pneumatically, magnetically, or electrically. In another aspect, the animal assembly further comprises removable and rotatable horns at the front of the animal assembly allowing for different horn sizes, shapes, and angles. In another aspect, the animal assembly is pulled from a tow bar or is self-propelling. In another aspect, a wheel assembly is positioned at the front of the animal assembly in contact with the ground, and 2, 3, or 4 wheels are positioned to the right, left, or both of a longitudinal centerline of the animal. In another aspect, the animal is bovine, ovine, equine, or swine. In another aspect, the actuation assembly includes: a wheel rotatably mounted on the frame in contact with the ground; and a linkage connecting the wheel to the leg assembly such that rotation of the wheel by the ground when the animal assembly is moved over the ground surface is transferred to the leg assembly to pivot the at least one leg member.

In another embodiment, the present invention includes a method for practicing animal roping comprising: providing an animal assembly, the animal assembly having: a front, a rear, and a pivot that provides an up and down motion at the rear of the animal assembly to simulate a hopping motion by the animal; a leg assembly mounted at the rear of the frame and including one or more leg members that are movable with respect to the frame to simulate a running motion; an actuation assembly configured to move the leg members from a forward position when the leg members touch the ground, during a stride such that the legs are in contact with the ground until they reach a rear facing position and the leg members are raised from the ground and kick; and the leg members are off the ground from the rear position to the front position; and one or more indicia that indicates to the user when the leg members are in an optimal position for roping, and then they are not accessible for roping and then the legs are accessible for roping; pulling the animal assembly to simulate the running motion of the animal; and providing the indicia at the optimal position for roping the leg members. In one aspect, the indicia are selected from at least one of a visual, an auditory, or a vibrational cue. In another aspect, the indicia are an auditory or a vibrational cue that is carried by the user. In another aspect, the indicia shows when the leg members are not in an optimal position for roping. In another aspect, the indicia is visual and is selected from a light, a colored light, an LED, an OLED, is a light that changes colors, the light traverses from the top to the bottom of a string of lights and vice versa, the lights are red and green, the light is intermittent, the light dims and intensifies, or the light pulses to indicate the correct time to rope the leg members. In another aspect, the leg members are defined further as comprising an ankle and a hock, wherein a visible indicia is positioned between the ankles and the hock, between the ankles and the rear of the animal assembly, between the hock and the rear of the animal assembly, on the rear of the animal assembly, or combinations thereof. In another aspect, the leg assembly is configured such that the lower end of at least one of the legs of the leg members contacts the ground surface for at least a portion of an arc of movement of the leg lower end in a manner that prevents a rope from looping about the at least one leg. In another aspect, at least one of the leg members comprises a foot extension member extending from the lower end of the at least one leg member for contacting the ground surface during at least a portion of the generally pivotal movement of the leg members. In another aspect, the leg members are coated or wrapped with a surface that simulates the hide of the animal. In another aspect, the indicia is turned on when the leg members are about the most rearward position and the indicia turns off at the top of the hop when the leg members are generally perpendicular to the ground. In another aspect, the hopping motion of the animal assembly, the movement of the leg members, or both, is driven mechanically, hydraulically, pneumatically, or electrically. In another aspect, the animal assembly further comprises removable and rotatable horns at the front of the animal assembly allowing for different horn sizes, shapes, and angles. In another aspect, the animal assembly is pulled from a tow bar or is self-propelling. In another aspect, a wheel assembly is positioned at the front of the animal assembly in contact with the ground, and 2, 3, or 4 wheels are positioned to the right, left, or both of a longitudinal centerline of the animal. In another aspect, the animal is bovine, ovine, equine, or swine. In another aspect, the actuation assembly includes: a wheel rotatably mounted on the frame in contact with the ground; and a linkage connecting the wheel to the leg assembly such that rotation of the wheel by the ground when the animal assembly is moved over the ground surface is transferred to the leg assembly to pivot the at least one leg member.

In another embodiment, the present invention includes a mechanical steer roping apparatus for practicing steer roping, the apparatus comprising: a steer assembly having a front, a rear, and a pivot that provides an up and down motion at the rear of the steer assembly to simulate a hopping motion by the steer; a leg assembly mounted at the rear of the frame and including leg members that are movable with respect to the frame to simulate a running motion; an actuation assembly configured to move the leg members from a forward position when the leg members touch the ground, during a stride such that the legs are in contact with the ground until they reach a rear facing position and the leg members are raised from the ground and kick; and the leg members are off the ground from the rear position to the front position; and one or more indicia that indicated to a user when the leg members are in an optimal position for roping, wherein the optimal position for roping the legs and when the indicia shows the optimal position is when the legs are fully extended until the leg members are perpendicular to the ground as the leg members to the ground during a hop.

In another embodiment, the present invention includes a method of making a mechanical steer roping apparatus for practicing steer roping, the apparatus comprising: providing a steer assembly having a front, a rear, and a pivot that provides an up and down motion at the rear of the steer assembly to simulate a hopping motion by the steer; adding a leg assembly mounted at the rear of the frame and including leg members that are movable with respect to the frame to simulate a running motion; including an actuation assembly configured to move the leg members from a forward position when the leg members touch the ground, during a stride such that the legs are in contact with the ground until they reach a rear facing position and the leg members are raised from the ground and kick; and the leg members are off the ground from the rear position to the front position; and positioning one or more indicia that indicates to a user when the leg members are in an optimal position for roping, wherein the optimal position for roping the legs and when the indicia shows the optimal position is when the legs are fully extended until the leg members are perpendicular to the ground as the leg members to the ground during a hop.

In another embodiment, the present invention includes a mechanical roping apparatus for practicing steer roping of an animal, the apparatus comprising: a steer assembly having a front, a rear, and a pivot that provides an up and down motion at the rear of the animal assembly to simulate a hopping motion by the animal; a leg assembly mounted at the rear of the frame and including leg members that are movable with respect to the frame to simulate a running motion; an actuation assembly configured to move the leg members from a forward position when the leg members touch the ground, during a stride such that the legs are in contact with the ground until they reach a rear facing position and the leg members are raised from the ground and kick; and the leg members are off the ground from the rear position to the front position; and a wheel assembly positioned at the front of the animal assembly in contact with the ground, and 2, 3, or 4 wheels are positioned to the right, left, or both of a longitudinal centerline of the animal.

In another embodiment, the present invention includes a mechanical roping apparatus for practicing animal roping, the apparatus comprising: an animal assembly comprising a front, a rear, a frame, and a pivot that provides an up and down motion at the rear of the frame to simulate a hopping motion by an animal; a leg assembly mounted at the rear of the frame and including leg members that are movable with respect to the animal assembly to simulate a running motion; and an actuation assembly configured to move the leg members from a forward position when the leg members touch the ground, during a stride such that the leg members are in contact with the ground until they reach a rear facing position and the leg members are raised from the ground and kick; and the leg members are off the ground from the rear position to the front position. In one aspect, the mechanical roping apparatus further comprises one or more indicia that indicate when the leg members are in an optimal position for roping. In another aspect, the one or more indicia are selected from at least one of a visual, an auditory, or a vibrational cue, and if the one or more indicia are an auditory or a vibrational cue the one or more indicia are optionally carried by the user. In another aspect, the one or more indicia show when the leg members are not in an optimal position for roping. In another aspect, the one or more indicia are visual and are selected from a light, a colored light, an LED, an OLED, is a light that changes colors, the light traverses from the top to the bottom of a string of lights and vice versa, the lights are red and green, the light is intermittent, the light dims and intensifies, or the light pulses to indicate the correct time to rope the leg members. In another aspect, the one or more indicia are turned on when the leg members are about the most rearward position and the one or more indicia turn off at the top of the hop when the leg members are generally perpendicular to the ground. In another aspect, the one or more indicia show a user when the leg members are in an optimal position for roping, wherein the optimal position for roping the leg members is when the leg members are fully extended until the leg members are perpendicular to the ground. In another aspect, the mechanical roping apparatus further comprises one or more lights to provide a focal point. In another aspect, the leg members are defined further as comprising an ankle and a hock, wherein a visible indicia is positioned between the ankles and the hock, between the ankles and the rear of the animal assembly, between the hock and the rear of the animal assembly, on the rear of the animal assembly, or combinations thereof, or optionally the leg assembly is configured such that the lower end of at least one of the legs of the leg members contacts the ground surface for at least a portion of an arc of movement of the leg lower end in a manner that prevents a rope from looping about the at least one leg, or optionally at least one of the leg members comprises a foot extension member extending from the lower end of the at least one leg member for contacting the ground surface during at least a portion of the generally pivotal movement of the leg members, or optionally the leg members are coated or wrapped with a surface that simulates the hide of the animal. In another aspect, a hopping motion of the animal assembly, the forward and rearward movement of the leg members, or both, is driven mechanically, hydraulically, pneumatically, magnetically, or electrically. In another aspect, the animal assembly further comprises removable and rotatable horns at the front of the animal assembly allowing for different horn sizes, shapes, and angles, and optionally the animal assembly is pulled from a tow bar or is self-propelling, or optionally the animal is bovine, ovine, equine, or swine. In another aspect, a wheel assembly is positioned at the front of the animal assembly in contact with the ground, and 2, 3, or 4 or more wheels are positioned to the right, left, or both of a longitudinal centerline of the animal. In another aspect, the actuation assembly includes: a wheel rotatably mounted on the frame in contact with the ground; and a linkage connecting the wheel to the leg assembly such that rotation of the wheel by the ground when the animal assembly is moved over the ground surface is transferred to the leg assembly to pivot at least one leg member.

In another embodiment, the present invention includes a method for practicing animal roping comprising: providing a mechanical roping apparatus, the mechanical roping apparatus comprising: an animal assembly comprising a front, a rear, a frame, and a pivot that provides an up and down motion at the rear of the animal assembly to simulate a hopping motion by an animal; a leg assembly mounted at the rear of the frame and including one or more leg members that are movable with respect to the frame to simulate a running motion; and an actuation assembly configured to move the leg members from a forward position when the leg members touch the ground, during a stride such that the leg members are in contact with the ground until they reach a rear facing position and the leg members are raised from the ground and kick; and the leg members are off the ground from the rear position to the front position; pulling the animal assembly to simulate the running motion of the animal; and operating the actuation assembly. In one aspect, the method further comprises providing one or more indicia that indicate when the leg members are in an optimal position for roping. In another aspect, the one or more indicia are selected from at least one of a visual, an auditory, or a vibrational cue, and if the one or more indicia are an auditory or a vibrational cue the one or more indicia are optionally carried by the user. In another aspect, the one or more indicia show when the leg members are not in an optimal position for roping. In another aspect, the one or more indicia are visual and are selected from a light, a colored light, an LED, an OLED, is a light that changes colors, the light traverses from the top to the bottom of a string of lights and vice versa, the lights are red and green, the light is intermittent, the light dims and intensifies, or the light pulses to indicate the correct time to rope the leg members. In another aspect, the one or more indicia are turned on when the leg members are about the most rearward position and the one or more indicia turn off at the top of the hop when the leg members are generally perpendicular to the ground. In another aspect, the one or more indicia show a user when the leg members are in an optimal position for roping, wherein the optimal position for roping the leg members is when the leg members are fully extended until the leg members are perpendicular to the ground. In another aspect, the method further comprises providing one or more lights to provide a focal point. In another aspect, the leg members are defined further as comprising an ankle and a hock, wherein a visible indicia is positioned between the ankles and the hock, between the ankles and the rear of the animal assembly, between the hock and the rear of the animal assembly, on the rear of the animal assembly, or combinations thereof, or optionally the leg assembly is configured such that the lower end of at least one of the legs of the leg members contacts the ground surface for at least a portion of an arc of movement of the leg lower end in a manner that prevents a rope from looping about the at least one leg, or optionally at least one of the leg members comprises a foot extension member extending from the lower end of the at least one leg member for contacting the ground surface during at least a portion of the generally pivotal movement of the leg members, or optionally the leg members are coated or wrapped with a surface that simulates the hide of the animal. In another aspect, the hopping motion of the animal assembly, the movement of the leg members, or both, is driven mechanically, hydraulically, pneumatically, or electrically. In another aspect, the animal assembly further comprises removable and rotatable horns at the front of the animal assembly allowing for different horn sizes, shapes, and angles, or optionally the animal assembly is pulled from a tow bar or is self-propelling, or optionally the animal is bovine, ovine, equine, or swine. In another aspect, a wheel assembly is positioned at the front of the animal assembly in contact with the ground, and 2, 3, or 4 or more wheels are positioned to the right, left, or both of a longitudinal centerline of the animal. In another aspect, the actuation assembly includes: a wheel rotatably mounted on the frame in contact with the ground; and a linkage connecting the wheel to the leg assembly such that rotation of the wheel by the ground when the animal assembly is moved over the ground surface is transferred to the leg assembly to pivot at least one leg member.

In another embodiment, the present invention includes a mechanical roping apparatus for practicing steer roping, the apparatus comprising: a steer assembly comprising a front, a rear, frame, and a pivot that provides an up and down motion at the rear of the frame to simulate a hopping motion by a steer; a leg assembly mounted at the rear of the frame and including leg members that are movable with respect to the steer assembly to simulate a running motion; an actuation assembly configured to move the leg members from a forward position when the leg members touch the ground, during a stride such that the leg members are in contact with the ground until they reach a rear facing position and the leg members are raised from the ground and kick; and the leg members are off the ground from the rear position to the front position; and a wheel assembly positioned at the front of the animal assembly in contact with the ground, and 2, 3, or 4 or more wheels are positioned to the right, left, or both of a longitudinal centerline of the steer assembly.

In another embodiment, the present invention includes a mechanical roping apparatus for practicing animal roping, the apparatus comprising: an animal assembly comprising a front, a rear, and a frame; a leg assembly mounted at the rear of the frame and including leg members; and 2, 3, or 4 or more skids positioned to the right, left, or both of a longitudinal centerline of the animal assembly.

In another embodiment, the present invention includes a mechanical roping apparatus for practicing animal roping, the apparatus comprising: a stand; and a leg assembly mounted on the stand and including leg members.

In another embodiment, the present invention includes method for practicing animal roping comprising providing a mechanical roping apparatus, the mechanical roping apparatus comprising: an animal assembly comprising a front, a rear, and a frame; a leg assembly mounted at the rear of the frame and including animal assembly leg members; and 2, 3, or 4 or more wheels or skids positioned to the right, left, or both of a longitudinal centerline of the animal assembly; or a stand and a leg assembly mounted on the stand and including stand leg members; and practicing roping the animal assembly leg members or the stand leg members.

In another embodiment, the present invention includes a mechanical roping apparatus for practicing animal roping including an animal assembly including a front, a rear, and a frame; a leg assembly mounted at the rear of the animal assembly—and including leg members; one or more indicia selected from a vibrational cue carried by a user, a visual cue, or an auditory cue, wherein the one or more indicia are configured to indicate to the user a proper time to rope a leg member using proper roping technique; two or more wheels or skids positioned to the right, left, or both of a longitudinal centerline of the animal assembly; and an arena float connected to the animal assembly, the arena float including a float connector connected to the animal assembly; a float arm rotatably connected to the float connector at a proximate end of the float arm such that the float arm is configured to rotate in a vertical plane, the float arm including one float arm segment or two or more float arm segments, wherein the two or more float arm segments are rotatably connected in sequence such that each of the two or more float arm segments are configured to rotate in the vertical plane; and a leveler connected to a distal end of the float arm and configured to condition material of an arena surface ahead of the wheels or the skids. In one aspect, the float connector is a tow bar. In another aspect, the float arm includes wood, metal, or a combination thereof. In another aspect, the one float arm segment or the two or more float arm segments are configured to be rotated and fixed in position to adjust a height of the leveler relative to the arena surface. In another aspect, the two or more float arm segments are configured to be rotated and fixed to adjust an angle of the leveler relative to the arena surface. In another aspect, the leveler includes wood, metal, or a combination thereof. In another aspect, the leveler includes a rake with a plurality of tines; a brush with a plurality of bristles, wires, or filaments; a blade; a smooth surface; a roughened surface; or a combination thereof. In another aspect, the leveler is connected rotatably to the float arm and configured to roll over the arena surface as the apparatus is moved on the arena surface. In another aspect, the apparatus further includes an indicia-actuation assembly including an indicia-actuation wheel rotatably mounted on the frame in contact with the ground, wherein the indicia-actuation wheel is configured to rotate as the apparatus is moved over the ground; an indicia-actuation pulley system including a pivot and quarter-circle plate rotatably mounted on the pivot and connected to the indicia-actuation wheel, wherein the quarter-circle plate is configured to rotate as the indicia-actuation wheel rotates; and an indicia-actuation switch connected to the quarter-circle plate and to the one or more indicia and configured to operate the one or more indicia as the quarter-circle plate rotates.

In another embodiment, the present invention includes a leveler kit including an arena float configured to be connected to a mechanical roping apparatus, the arena float including a float arm rotatably connected to the float connector at a proximate end of the float arm such that the float arm is configured to rotate in a vertical plane, the float arm including one float arm segment or two or more float arm segments, wherein the two or more float arm segments are configured to be rotatably connected in sequence such that each of the two or more float arm segments are configured to rotate in the vertical plane; and a leveler configured to be connected to a distal end of the float arm and configured to condition material of an arena surface ahead of the wheels or the skids; and one or more fasteners configured to connect the float arm to a float connector of a mechanical roping apparatus, to connect the two or more float arm segments in sequence, or to connect the leveler to the float arm. In one aspect, the float arm includes wood, metal, or a combination thereof. In another aspect, the one float arm segment or the two or more float arm segments are configured to be rotated and fixed in position to adjust a height of the leveler relative to the arena surface. In another aspect, the two or more float arm segments are configured to be rotated and fixed to adjust an angle of the leveler relative to the arena surface. In another aspect, the leveler includes wood, metal, or a combination thereof. In another aspect, the leveler includes a rake with a plurality of tines; a brush with a plurality of bristles, wires, or filaments; a blade; a smooth surface; a roughened surface; or a combination thereof. In another aspect, the leveler is connected rotatably to the float arm and configured to roll over the arena surface as the apparatus is moved on the arena surface. In another aspect, the kit further includes the float connector, wherein the float connector is configured to be connected to the mechanical roping apparatus and to the proximate end of the float arm.

In another embodiment, the present invention includes a method of conditioning an arena surface for a mechanical roping apparatus, the method including providing the a mechanical roping apparatus for practicing animal roping including an animal assembly including a front, a rear, and a frame; a leg assembly mounted at the rear of the animal assembly—and including leg members; one or more indicia selected from a vibrational cue carried by a user, a visual cue, or an auditory cue, wherein the one or more indicia are configured to indicate to the user a proper time to rope a leg member using proper roping technique; two or more wheels or skids positioned to the right, left, or both of a longitudinal centerline of the animal assembly; providing an arena float connected to the animal assembly, the arena float including a float connector connected to the animal assembly; a float arm rotatably connected to the float connector at a proximate end of the float arm such that the float arm is configured to rotate in a vertical plane, the float arm including one float arm segment or two or more float arm segments, wherein the two or more float arm segments are rotatably connected in sequence such that each of the two or more float arm segments are configured to rotate in the vertical plane; and a leveler connected to a distal end of the float arm and configured to condition material of an arena surface ahead of the wheels or the skids; connecting the arena float to the mechanical roping apparatus; adjusting the height, angle, or both of the leveler relative to the arena surface to contact the arena surface; and moving the mechanical roping apparatus on the arena surface, thereby conditioning the arena surface with the leveler. In one aspect, the float connector is a tow bar. In another aspect, the float arm includes wood, metal, or a combination thereof. In another aspect, the one float arm segment or the two or more float arm segments are configured to be rotated and fixed in position to adjust a height of the leveler relative to the arena surface. In another aspect, the two or more float arm segments are configured to be rotated and fixed to adjust an angle of the leveler relative to the arena surface. In another aspect, the leveler includes wood, metal, or a combination thereof. In another aspect, the leveler includes a rake with a plurality of tines; a brush with a plurality of bristles, wires, or filaments; a blade; a smooth surface; a roughened surface; or a combination thereof. In another aspect, the leveler is connected rotatably to the float arm and configured to roll over the arena surface as the apparatus is moved on the arena surface.

In another embodiment, the present invention includes a mechanical roping apparatus for practicing animal roping including an animal assembly including a front, a rear, and a frame; a leg assembly mounted at the rear of the animal assembly—and including leg members; one or more indicia selected from a vibrational cue carried by a user, a visual cue, or an auditory cue, wherein the one or more indicia are configured to indicate to the user a proper time to rope a leg member using proper roping technique; two or more wheels or skids positioned to the right, left, or both of a longitudinal centerline of the animal assembly; and an indicia-actuation assembly including an indicia-actuation wheel rotatably mounted on the frame in contact with the ground, wherein the indicia-actuation wheel is configured to rotate as the apparatus is moved over the ground; an indicia-actuation pulley system including a pivot and quarter-circle plate rotatably mounted on the pivot and connected to the indicia-actuation wheel, wherein the quarter-circle plate is configured to rotate as the indicia-actuation wheel rotates; and an indicia-actuation switch connected to the quarter-circle plate and to the one or more indicia and configured to operate the one or more indicia as the quarter-circle plate rotates.

In another embodiment, the present invention includes a mechanical roping apparatus for practicing animal roping, the apparatus including an animal assembly including a front, a rear, and a frame; a leg assembly mounted at the rear of the animal assembly and including leg members; one or more indicia mounted on the leg members, wherein the one or more indicia are a visual cue configured to indicate to a user a proper time to rope a leg member using proper roping technique, wherein the visual cue is selected from a light that changes colors, a light that traverses between a top to a bottom of a string of lights, lights that are red and green, or a light that dims and intensifies; an indicia actuation assembly including an indicia wheel rotatably mounted on the frame in contact with the ground; an indicia switch connected to the indicia wheel and to the one or more indicia and configured to operate the one or more indicia, wherein the switch is configured to operate as the indicia wheel turns when the animal assembly is moved; and two, three, or four or more skids positioned to the right, left, or both of a longitudinal centerline of the animal assembly. In one aspect, the animal assembly further includes a first pivot positioned on the frame between a front and a rear of the frame and around which the frame rotates, and a second pivot positioned on the frame at the front of the frame and around which the frame rotates, so that the rear of the animal assembly moves up and down as the frame rotates at least around the first pivot and the second pivot to simulate a hopping motion by an animal; and a leg actuation assembly including a leg actuation wheel rotatably mounted on the frame in contact with the ground; and a linkage connecting the leg actuation wheel to the leg assembly such that rotation of the leg actuation wheel by the ground is transferred to the leg assembly to pivot at least one of the leg members when the animal assembly is moved over the ground surface; wherein the leg actuation assembly is configured to move the leg members from a forward position when the leg members touch the ground, during a stride such that the leg members are in contact with the ground until they reach a rear facing position and the leg members are raised from the ground and kick; and the leg members are off the ground from the rear facing position to the forward position. In another aspect, the visual cue is selected from a light, a colored light, an LED, or an OLED. In another aspect, the apparatus further includes one or more lights to provide a focal point. In another aspect, the animal assembly further includes a body with removable and rotatable horns at the front of the animal assembly allowing for different horn sizes, shapes, and angles; or wherein the apparatus is configured to be pulled from a tow bar; or wherein the animal assembly simulates an animal that is bovine, ovine, equine, or swine.

In another embodiment, the present invention includes a method for practicing animal roping including providing a mechanical roping apparatus including an animal assembly including a front, a rear, and a frame; a leg assembly mounted at the rear of the animal assembly and including leg members; one or more indicia mounted on the leg members, wherein the one or more indicia are a visual cue configured to indicate to a user a proper time to rope a leg member using proper roping technique, wherein the visual cue is selected from a light that changes colors, a light that traverses between a top to a bottom of a string of lights, lights that are red and green, or a light that dims and intensifies; an indicia actuation assembly including an indicia wheel rotatably mounted on the frame in contact with the ground; and practicing roping the leg members. In one aspect, the animal assembly further includes a first pivot positioned on the frame between a front and a rear of the frame and around which the frame rotates, and a second pivot positioned on the frame at the front of the frame and around which the frame rotates, so that the rear of the animal assembly moves up and down as the frame rotates at least around the first pivot and the second pivot to simulate a hopping motion by an animal; and a leg actuation assembly including a leg actuation wheel rotatably mounted on the frame in contact with the ground; a linkage connecting the leg actuation wheel to the leg assembly such that rotation of the leg actuation wheel by the ground is transferred to the leg assembly to pivot at least one of the leg members when the animal assembly is moved over the ground surface; wherein the leg actuation assembly is configured to move the leg members from a forward position when the leg members touch the ground, during a stride such that the leg members are in contact with the ground until they reach a rear facing position and the leg members are raised from the ground and kick; and the leg members are off the ground from the rear facing position to the forward position. In another aspect, the visual cue is selected from a light, a colored light, an LED, or an OLED. In another aspect, the apparatus further includes one or more lights to provide a focal point. In another aspect, wherein the animal assembly further includes removable and rotatable horns at the front of the animal assembly allowing for different horn sizes, shapes, and angles; or wherein the animal assembly simulates an animal that is bovine, ovine, equine, or swine.

In another embodiment, the present invention includes a mechanical roping apparatus for practicing animal roping including an animal assembly including a front, a rear, and a frame; a leg assembly mounted at the rear of the animal assembly—and including leg members; one or more indicia including a visual cue, wherein the one or more indicia are configured to indicate to a user a proper time to rope a leg member using proper roping technique; two or more wheels or skids positioned to the right, left, or both of a longitudinal centerline of the animal assembly; and an arena float connected to the animal assembly, the arena float including a float connector connected to the animal assembly; a float arm rotatably connected to the float connector at a proximate end of the float arm such that the float arm is configured to rotate in a vertical plane, the float arm including one float arm segment or two or more float arm segments, wherein the two or more float arm segments are rotatably connected in sequence such that each of the two or more float arm segments are configured to rotate in the vertical plane; and a leveler connected to a distal end of the float arm and configured to condition material of an arena surface ahead of the wheels or the skids. In one aspect, the float connector is a tow bar. In another aspect, the float arm includes wood, metal, or a combination thereof. In another aspect, the one float arm segment or the two or more float arm segments are configured to be rotated and fixed in position to adjust a height of the leveler relative to the arena surface. In another aspect, the two or more float arm segments are configured to be rotated and fixed to adjust an angle of the leveler relative to the arena surface. In another aspect, the leveler includes wood, metal, or a combination thereof. In another aspect, the leveler includes a rake with a plurality of tines; a brush with a plurality of bristles, wires, or filaments; a blade; a smooth surface; a roughened surface; or a combination thereof. In another aspect, the leveler is connected rotatably to the float arm and configured to roll over the arena surface as the apparatus is moved on the arena surface. In another aspect, the apparatus further includes an indicia-actuation wheel rotatably mounted on the frame in contact with the ground, wherein the indicia-actuation wheel is configured to rotate as the apparatus is moved over the ground; an indicia-actuation pulley system including a pivot and quarter-circle plate rotatably mounted on the pivot and connected to the indicia-actuation wheel, wherein the quarter-circle plate is configured to rotate as the indicia-actuation wheel rotates; and an indicia-actuation switch connected to the quarter-circle plate and to the one or more indicia and configured to operate the one or more indicia as the quarter-circle plate rotates.

In another embodiment, the present invention includes a leveler kit including an arena float configured to be connected to a mechanical roping apparatus, the arena float including a float arm configured to be rotatably connected to a float connector at a proximate end of the float arm such that the float arm is configured to rotate in a vertical plane, the float arm including one float arm segment or two or more float arm segments, wherein the two or more float arm segments are configured to be rotatably connected in sequence such that each of the two or more float arm segments are configured to rotate in the vertical plane; and a leveler configured to be connected to a distal end of the float arm and configured to condition material of an arena surface ahead of wheels or skids; and one or more fasteners configured to connect the float arm to a float connector of a mechanical roping apparatus, to connect the two or more float arm segments in sequence, or to connect the leveler to the float arm. In one aspect, the leveler includes a rake with a plurality of tines; a brush with a plurality of bristles, wires, or filaments; a blade; or a roughened surface. In another aspect, the leveler is connected rotatably to the float arm and configured to roll over the arena surface as the apparatus is moved on the arena surface.

In another embodiment, the present invention includes a method of conditioning an arena surface for a mechanical roping apparatus, the method including providing the mechanical roping apparatus including an animal assembly including a front, a rear, and a frame; a leg assembly mounted at the rear of the animal assembly—and including leg members; one or more indicia including a visual cue, wherein the one or more indicia are configured to indicate to a user a proper time to rope a leg member using proper roping technique; and two or more wheels or skids positioned to the right, left, or both of a longitudinal centerline of the animal assembly; providing an arena float including a float connector connected to the animal assembly; a float arm rotatably connected to the float connector at a proximate end of the float arm such that the float arm is configured to rotate in a vertical plane, the float arm including one float arm segment or two or more float arm segments, wherein the two or more float arm segments are rotatably connected in sequence such that each of the two or more float arm segments are configured to rotate in the vertical plane; and a leveler connected to a distal end of the float arm and configured to condition material of an arena surface ahead of the wheels or the skids; connecting the arena float to the mechanical roping apparatus; adjusting the height, angle, or both of the leveler relative to the arena surface to contact the arena surface; and moving the mechanical roping apparatus on the arena surface, thereby conditioning the arena surface with the leveler.

BRIEF DESCRIPTION OF THE DRAWINGS

For a more complete understanding of the features and advantages of the present invention, reference is now made to the detailed description of the invention along with the accompanying figures and in which.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

The present invention improves on known steer roping practice devices by providing the trainee with indicia of the best time to rope the hind legs of an animal. The hind legs of the mechanical roping practice apparatus are generally roped or lassoed when the hind leg or legs are moving along a forward portion of the arc of movement, during a hop, until the rear legs are perpendicular to the ground as the legs move forward. Even when it is possible to rope the hind legs at a position forward from the position at which the rear legs are perpendicular to the ground, it is not considered to be good roping technique. The present invention can be used for a wide variety of roping applications. While the examples herein are shown with a steer as an exemplary animal, many other animals for which roping practice may be sought are also encompassed by the present invention, such as but not limited to, bovine, ovine, equine, swine, which animals can be young or full grown. The present invention is shown using a steer as an example, and the present invention includes mechanical training devices for any animal for which roping practice is sought.

Unlike other known steer roping practice devices, in one embodiment the present invention provides a combination of movement of the legs along the ground and in the air, while at the same time mimicking the jumping motion of the steer. The present invention provides the indicia of when the proper roping technique is used by indicating the correct time to rope the hind leg or legs, and then turns off when the incorrect time for roping is indicated. Therefore, the user and observers of the roping practice can track if proper technique is applied, but also when the hind leg or legs are roped, reflecting incorrect roping technique.

Figure 1:
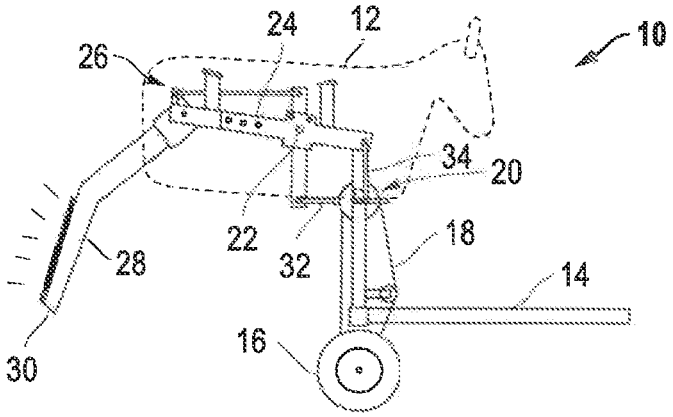
FIG. 1 shows a side view of a mechanical roping steer of the present invention in a first position at the end of a stride.

FIG. 1 shows a side view of a mechanical roping steer apparatus 10 of the present invention in a first position at the end of a stride and the internal mechanisms therein. The body 12 of the mechanical roping steer apparatus 10 may include, e.g., the rest of the body of the steer such as horns and optionally front legs (not depicted). The mechanical roping steer apparatus 10 can include a tow bar 14 and a wheel or wheels 16. The wheel or wheels 16 are connected via a belt 18 to a pulley system 20. The wheel or wheels 16, belt 18, and pulley system 20 further control both the up and down motion of the body 12 along frame 24 of the steer via pivot 22, but also the motion via pivot 26 of the hind leg member or leg members 28. During this portion of the jump and leg extension cycle, the lights 30 are in the on position, which indicates to the user that this is the proper time to rope the hind leg member or leg members 28 if following proper roping technique.

The indicium shown in the figures is light, however, the skilled artisan will recognize that sound or vibration may also be used as one of the indicia, which indicia are not mutually exclusive, that is, more than one indicium may be used at the same and/or different times. Any variation of the same is encompassed by the present invention, as are various positions (for visual cues) for the indicium. If using sound, for example, the sound can be varied to indicate the proper time to rope the hind leg member or leg members 28, such as using a tone that changes pitch, intermittent sound that indicates with an increase in pitch or volume, or the presence or absence of sound, or any combination thereof, to indicate to the user when is the best time in the cycle to rope the hind leg member or leg members 28. The volume of the sound and/or intensity or rate of intermittent sound may be used to indicate to the user when the proper time is approaching, during the duration of the proper roping time, when the time is ending, and when it is not proper technique to rope. Likewise, the light or visual cue can be varied in similar manner, e.g., with the lights on or off, with a change in the rate of blinking of the light(s), by having a red (no-go) versus green (go), or even a spectrum of color and/or intensity to indicate to the user when the proper time is approaching, during the duration of the proper roping time, when the time is ending, and when it is not proper technique to rope. An example of a visual cue includes an indicator that has up or down arrows, a flag, a wheel with one color for go and another for stop, stop and go signaling, or other indicator whether mechanical or in the form of a light (or both light and mechanical) that can be seen by the user during roping practice. Another indicium is vibration, which could be a device carried or worn by the user (non-limiting examples including a smartphone, a smartwatch, and/or other dedicated device) that provide the user with vibration that indicates to the user when the proper time is approaching, during the duration of the proper roping time, when the time is ending, and when it is not proper technique to rope.

Figure 2:
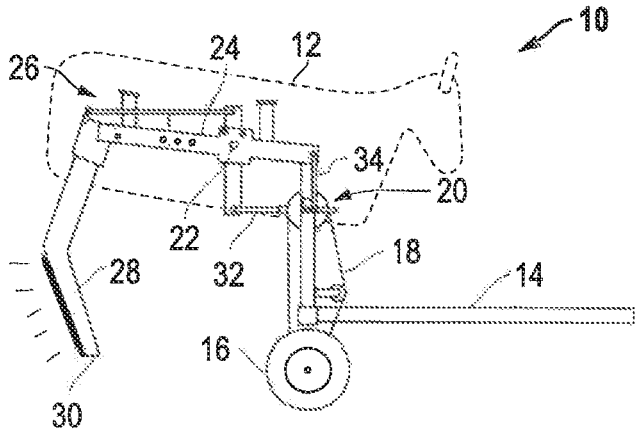
FIG. 2 shows a side view of a mechanical roping steer of the present invention in a second position as the legs move from the rear toward the front.

FIG. 2 shows a side view of a mechanical roping steer apparatus 10 of the present invention in a second position as the steer apparatus is jumping and the hind leg member or leg members 28 are moving toward the forward position and showing the lights 30 on until the legs reach the point in the cycle when it is improper technique to rope the hind leg member or leg members 28.

Figure 3:
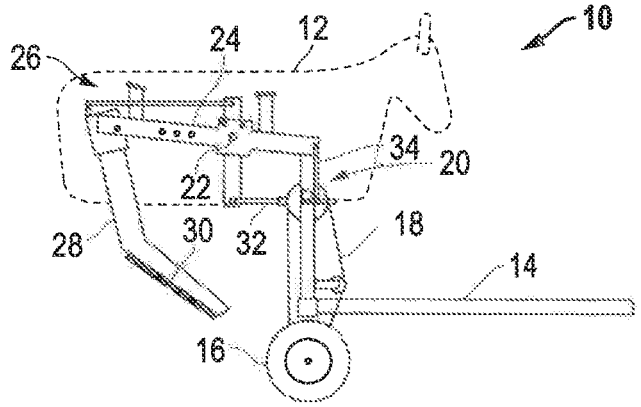
FIG. 3 shows a side view of a mechanical roping steer of the present invention in a third position with the hip halfway down and the legs are all the way forward.

FIG. 3 shows a side view of a mechanical roping steer apparatus 10 of the present invention in a third position with the hip halfway down and the legs are all the way forward, that is, when the hind leg member or leg members 28 are in the forward position and the frame 24 has brought the hind leg member or leg members 28 in contact with the ground and roping is not proper and/or possible.

Figure 4:
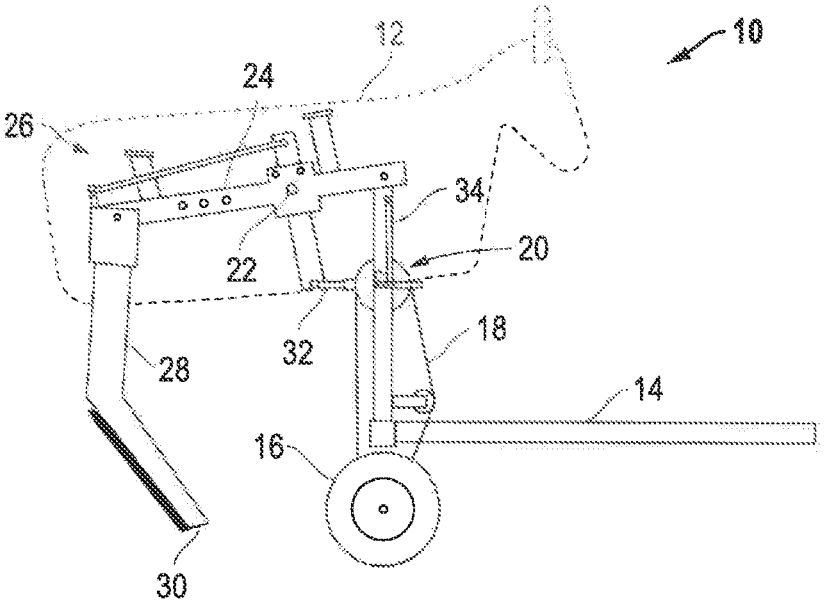
FIG. 4 shows a side view of a mechanical roping steer of the present invention in a fourth position where the hip is all the way down and the legs are mid stride.

FIG. 4 shows a side view of a mechanical roping steer apparatus 10 of the present invention in a fourth position where the hip 26 is all the way down and the hind leg member or leg members 28 are mid stride moving from front to back.

When viewed together, FIGS. 1 to 4 show that as the mechanical roping steer apparatus 10 is towed the wheel or wheels 16 turn the belt 18, which turns the pulley system 20. Two arms 32, 34 are attached to the pulley system 20 and one arm 32 makes legs travel forward/backwards and the other arm 34 makes the hip 26 move up/down. The mechanical roping steer apparatus 10 pivots in the middle (pivot 22) of the frame 24.

Figure 5:
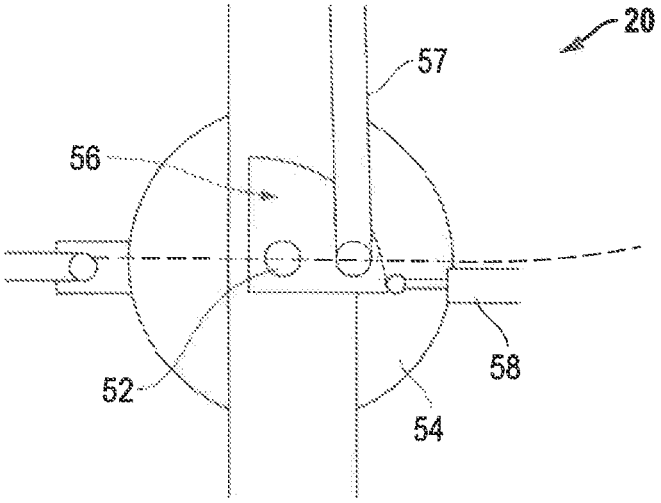
FIG. 5 is a detailed side view of one implementation of the mechanism for controlling the indicia, e.g., lights of the present invention.

FIG. 5 is a detailed side view of one implementation of the pulley system 20 for controlling the indicia, e.g., lights 30 of the present invention. A light switch 58 is triggered by the quarter circle plate 56 on pulley system 20 about a pivot 52, that is on a wheel 54. The wheel 54 can be connected to an arm 57 that transfers motion to other parts of the mechanical roping steer apparatus, such as the pivot that provides for an up and down motion for the mechanical roping steer apparatus that simulates jumping. The indicia in the hind leg or legs come on with hind leg or legs in the fully extended rear position and/or until the top of the hop with hind leg or legs straight down (perpendicular to the ground), at which point the indicia is reduced to zero or eliminated. For example, lights can be located on any part of the hind leg or legs or even the hip, anywhere on the mechanical roping steer apparatus, the horns, the wheels, the tow bar, or even the device pulling the mechanical roping steer apparatus. Generally, the lights will be located in a location that permits the user to best determine the optimal position of the hind leg or legs for roping, e.g., from hock to ankle of leg, the feet, on our about the lower, middle, upper portion of the hind leg or legs.

Figure 6:
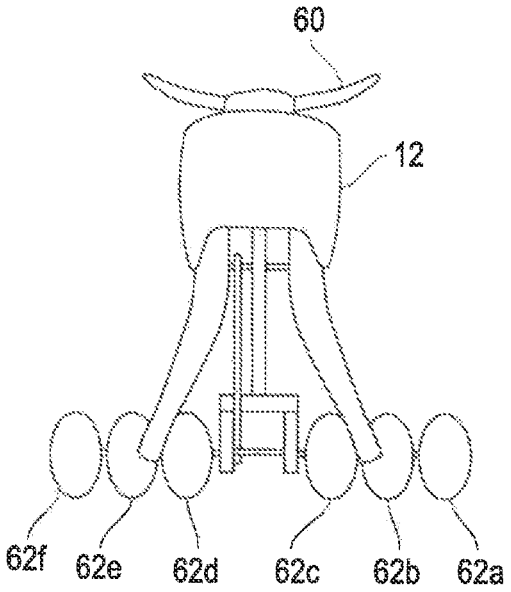
FIG. 6 is a rear view of a mechanical roping steer of the present invention showing a mechanism for increasing the stability of the mechanical roping steer.

FIG. 6 is a rear view of a mechanical roping steer apparatus 60 of the present invention showing a mechanism for increasing the stability of the mechanical roping steer. The mechanical roping steer apparatus 60 depicted is shown from a rear view and includes, in this embodiment, six wheels 62*a*-62*f*. It has been found that having more than two wheels provides for increased stability. For example, the mechanical roping steer apparatus 60 can include 3, 4, 5, 6, 7, 8, 9, or even 10 wheels or more, which wheels can be evenly distributed between the right and left side of the mechanical roping steer apparatus 60, or unevenly distributed to provide more stability to one or the other side. It has been found that the mechanical roping steer apparatus makes the sharpest corners, as would a normal animal, using the extended tire design, e.g., the 6 tire design. It was found that the mechanical roping steer apparatus has a lot more traction throughout the corner. It was further found that when the mechanical roping steer apparatus tilts one way or the other, one tire is always in contact with the ground and prevents the hop from stalling throughout the corner.

A mechanical roping apparatus according to the present invention may have one or more lights to provide a focal point, instead of or in addition to the lights 30, as shown in FIGS. 1-4, 7-8, 9C, 10A, and 10B.

A method for practicing animal roping according to the present invention uses a mechanical roping apparatus with an animal assembly 12, a leg assembly mounted on the animal assembly 12 and including leg members 28 that are movable with respect to the animal assembly 12 to simulate a running motion, an actuation assembly configured to move the leg members 28 from a forward position when the leg members 28 touch the ground, during a stride such that the leg members 28 are in contact with the ground until they reach a rear facing position and the leg members 28 are raised from the ground and kick; and the leg members 28 are off the ground from the rear position to the front position.

Figure 8:
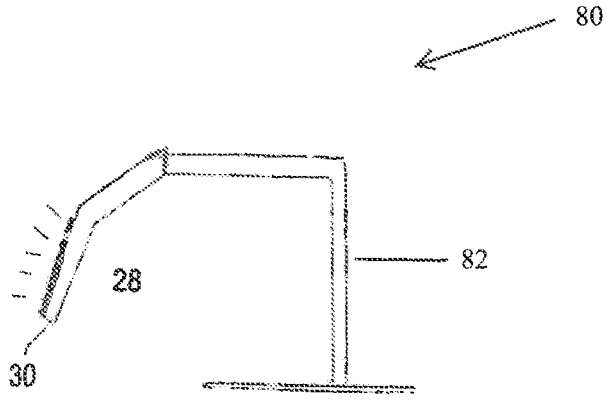
FIG. 8 is a side view of yet another mechanical roping apparatus of the present invention.

A mechanical roping apparatus for practicing roping of a steer according to the present invention may include a stand 80 as shown in FIG. 8, a leg assembly attached to or integral with the stand 80 and including leg members 28 that are movable with respect to the stand 80 to simulate a running motion; and an actuation assembly configured to move the leg members 28 from a forward position when the leg members 28 touch the ground, during a stride such that the leg members 28 are in contact with the ground until they reach a rear facing position and the leg members 28 are raised from the ground and kick; and the leg members 28 are off the ground from the rear position to the front position.

Figure 7:
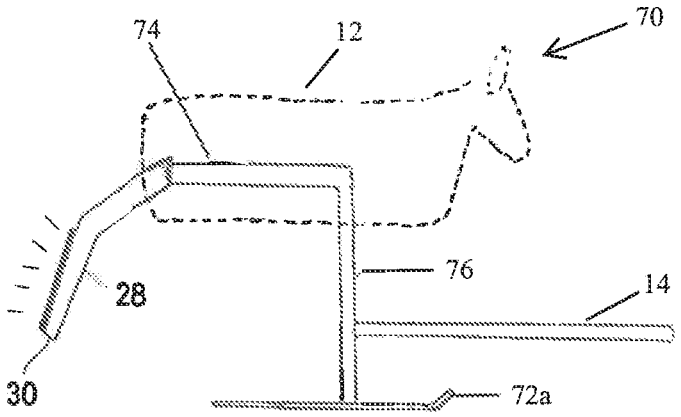
FIG. 7 is a side view of still another mechanical roping apparatus of the present invention.

FIG. 7 is a side view of still another mechanical roping apparatus of the present invention. In FIG. 7, the mechanical roping apparatus 70 includes two skids, skid 72*a* (shown) and another skid (not shown); the animal assembly 74; which has a front, a rear, and a frame 76, and to which the skids are attached or with which the skids are integral; the tow bar 14, which is attached to or integral with the animal assembly 74, and the leg members 28, which are attached to or integral with the animal assembly 74 with optional indicia as described elsewhere herein such as optional lights 30. The optional body 12 of the mechanical roping apparatus 80 may include, e.g., the rest of the body of the steer, removable and rotatable horns at the front of the animal assembly allowing for different horn sizes, shapes, and angles and optionally front legs (not depicted).

It will be understood that any embodiment of the present invention may include a mechanical roping apparatus such as those shown in FIGS. 1-4 and 6-7 with a pulley system such as the pulley systems shown in FIGS. 1-6 and discussed herein. It will be further understood that the pulley system can be driven by a wheel configured to be in contact with the ground such as wheel 16 or a wheel dedicated to the pulley system. In addition, it will be understood that any embodiment of the present invention may include an indicia-actuation assembly including an indicia-actuation wheel rotatably mounted on the frame in contact with the ground, wherein the indicia-actuation wheel is configured to rotate as the apparatus is moved over the ground; and an indicia-actuation pulley system, e.g., the pulley system 20, including a pivot 52 and quarter-circle plate 56 rotatably mounted on the pivot 52 and connected to the indicia-actuation wheel, wherein the quarter-circle plate 56 is configured to rotate as the indicia-actuation wheel rotates; and an indicia-actuation switch 58 connected to the quarter-circle plate 56 and to the one or more indicia and configured to operate the one or more indicia as the quarter-circle plate 56 rotates.

FIG. 8 is a side view of yet another mechanical roping apparatus of the present invention. In FIG. 8, mechanical roping apparatus 80 includes a stand 82 and leg members 28 attached to or integral with on the stand 82 with, optional indicia as described elsewhere herein such as optional lights 30. The stand 82 can be in any configuration that is stable with the leg members 28 attached to or integral with the stand 82. The optional body 12 (not shown) of the mechanical roping apparatus 80 may include, e.g., the rest of the body of the steer, removable and rotatable horns at the front of the animal assembly allowing for different horn sizes, shapes, and angles and optionally front legs (not depicted).

Figure 9A:
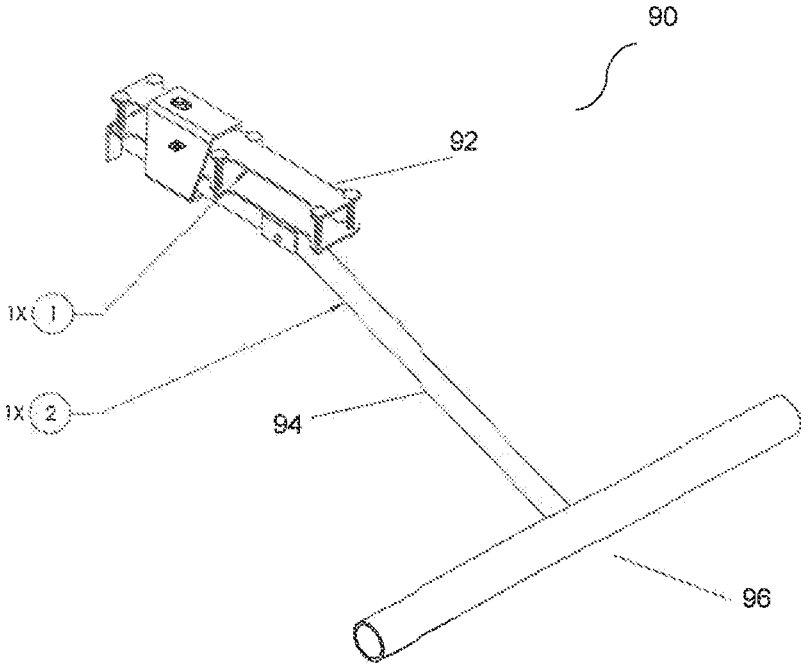
FIGS. 9A and 9B show an arena float for conditioning an arena surface to obtain a desired operating environment.
Figure 9B:
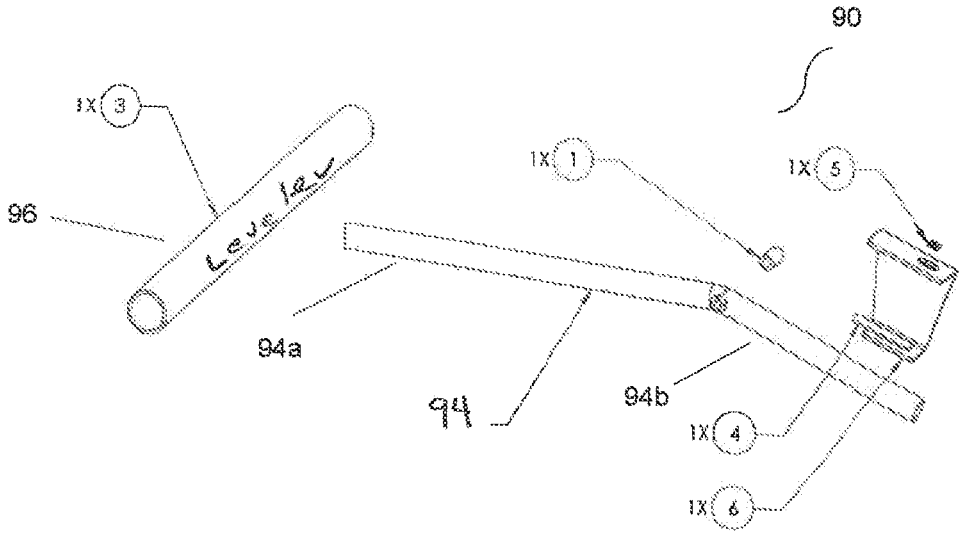

FIGS. 9A and 9B show exemplary, non-limiting embodiments of the present invention that include an arena float for conditioning an arena surface to obtain a desired operating environment. FIG. 9A shows an arena float 90 that includes a float connector 92, a float arm 94, and a leveler 96. The float connector 92 is configured to be connected to an animal assembly of the mechanical roping apparatus for practicing animal roping such as one of those shown in FIGS. 1-4 and 6-7 and described herein (where the mechanical roping apparatus is not shown in FIG. 9A). The float arm 94 is rotatably connected to the float connector 92 at a proximate end of the float arm 94 such that the float arm 94 is configured to rotate in a vertical plane. The float arm 94 can also be configured at a fixed angle at the proximate end of the float arm 94. The float arm 94 shown includes one float arm segment. The leveler 96 is connected to a distal end of the float arm 94 and is configured to condition material of an arena surface (e.g., soil) ahead of the wheels or the skids of the mechanical roping apparatus as it is moved on an arena surface, where the conditioning of the material may include but is not limited to leveling the material, smoothing the material, compacting the material, or churning the material. In one aspect, the float connector 92 is a tow bar. In another aspect, the float arm 94 includes wood, metal, or a combination thereof. In another aspect, the one float arm segment is configured to be rotated and fixed in position to adjust a height of the leveler 96 relative to the arena surface. In another aspect, the leveler 96 includes wood, metal, or a combination thereof. In another aspect, the leveler 96 includes a rake with a plurality of tines; a brush with a plurality of bristles, wires, or filaments; a blade; a smooth surface; a roughened surface; or a combination thereof.

FIG. 9B shows an arena float 90 that includes the float connector 92 (not shown), the float arm 94, and the leveler 96. The float connector 92 is configured to be connected to an animal assembly mechanical roping apparatus for practicing animal roping such as one of those shown in FIGS. 1-4 and 6-7 and described herein (where the mechanical roping apparatus is not shown in FIG. 9A). The float arm 94 is rotatably connected to the float connector 92 at a proximate end of the float arm 94 such that the float arm 94 is configured to rotate in a vertical plane. The float arm 94 can also be configured at a fixed angle near the proximate end of the float arm 94. The float arm 94 includes two or more float arm segments 94*a*, 94*b* (where the two float arm segments 94*a*, 94*b* shown are representative or two or more float arm segments and are not limiting), wherein the two or more float arm segments 94*a*, 94*b* are rotatably connected in sequence such that each of the two or more float arm segments 94*a*, 94*b* are configured to rotate in the vertical plane. The float arm 94 can also include a single float arm segment (not shown) with a fixed angle near the proximate end of the float arm. The leveler 96 is connected to a distal end of the float arm 94 and is configured to condition material of an arena surface (e.g., soil) ahead of the wheels or the skids of the mechanical roping apparatus as it is moved on an arena surface, where the conditioning of the material includes but is not limited to leveling the material, smoothing the material, compacting the material, or churning the material. In one aspect, the float connector 92 is a tow bar. In another aspect, the float arm 94 includes wood, metal, or a combination thereof. In another aspect, the two or more float arm segments 94*a*, 94*b* are configured to be rotated and fixed in position to adjust a height of the leveler 96 relative to the arena surface. In another aspect, the two or more float arm segments 94*a*, 94*b* are configured to be rotated and fixed to adjust an angle of the leveler 96 relative to the arena surface. In another aspect, the leveler 96 includes wood, metal, or a combination thereof. In another aspect, the leveler 96 includes a rake with a plurality of tines; a brush with a plurality of bristles, wires, or filaments; a blade; a smooth surface; a roughened surface; or a combination thereof.

Figure 9C:
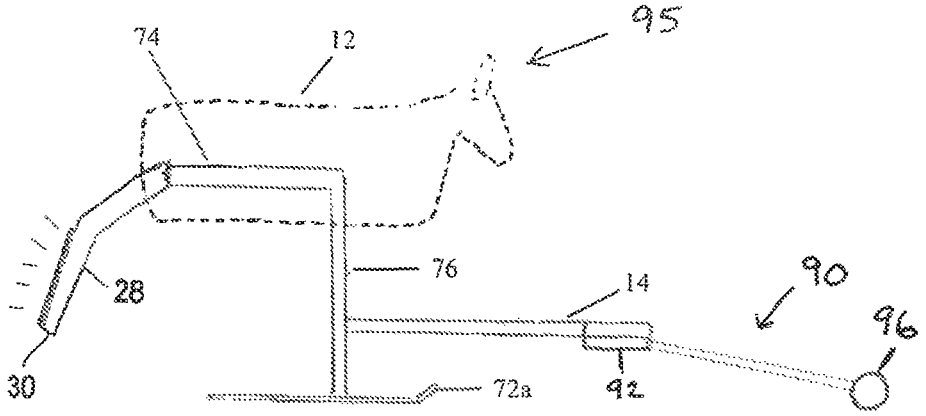
FIG. 9C shows an arena float connected to a mechanical roping apparatus.

FIG. 9C shows an exemplary, non-limiting embodiment of the present invention that includes an arena float for conditioning an arena surface to obtain a desired operating environment. FIG. 9C shows a mechanical roping apparatus 95 that is similar to the mechanical roping apparatus 70 that is shown in FIG. 7 and described herein. FIG. 9C shows the mechanical roping apparatus 95 connected to an arena float 90 as shown in FIGS. 9A and 9B and described herein. FIG. 9C shows the mechanical roping apparatus 95 connected to the arena float 90 via float connector 92 and the tow bar 14. The arena float of the present invention, exemplified by the arena float 90, can be used with a variety of mechanical roping apparatuses, such as the mechanical roping apparatuses 10, 70, 95, 100, and 150, which are shown and described herein.

The arena float of the present invention, exemplified by the arena float 90, which is shown and described herein, can be included in a kit together with one or more fasteners configured to connect the float arm to a float connector of a mechanical roping apparatus, to connect the two or more float arm segments in sequence, or to connect the leveler to the float arm.

An embodiment of the present invention includes a method for conditioning an arena surface for a mechanical roping apparatus including providing a mechanical roping apparatus such as the mechanical roping apparatuses 10, 70, 95, 100, and 150, which are shown and described herein. The method also includes providing an arena float such as the exemplary arena float 90 as shown and described herein. The method further includes connecting the arena float to the mechanical roping apparatus and adjusting the height, angle, or both, of the leveler relative to the arena surface to contact the arena surface. In addition, the method also includes moving the mechanical roping apparatus on the arena surface, thereby conditioning the arena surface with the leveler.

Figure 10A:
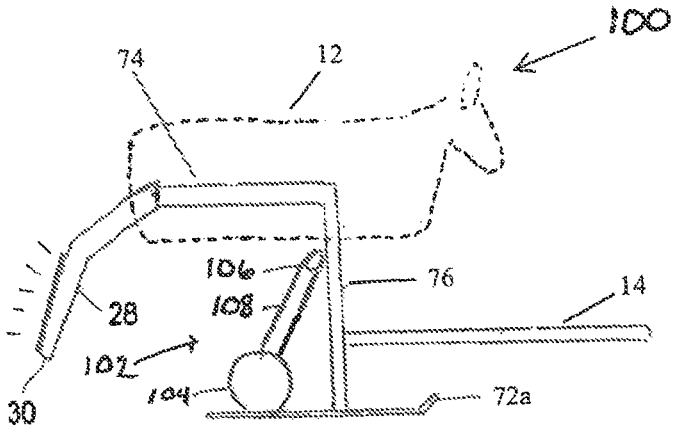
FIG. 10A shows a mechanical roping apparatus including an indicia actuation assembly.
Figure 10B:
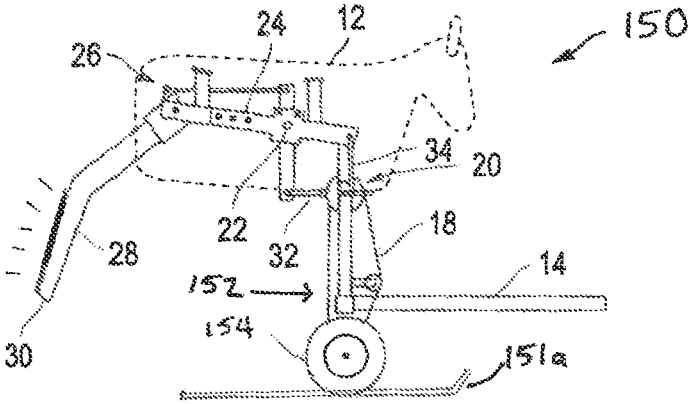
FIG. 10B shows a mechanical roping apparatus including a leg actuation assembly.

FIGS. 10A and 10B show exemplary, non-limiting embodiments of the present invention that include an animal assembly that is mounted skids and an indicia actuation assembly.

FIG. 10A shows a mechanical roping apparatus 100 that is similar to the mechanical roping apparatus 70 that is shown in FIG. 7 and described herein, except that the mechanical roping apparatus 100 has an indicia actuation assembly 102. The indicia actuation assembly 102 includes an indicia wheel 104 rotatably mounted on the frame in contact with the ground and an indicia switch 106 connected to the indicia wheel 104 by a pulley 108 and to the one or more indicia 30 (represented in FIG. 10A by exemplary lights 30) and configured to operate the one or more indicia, wherein the switch 106 is configured to operate as the indicia wheel 104 turns when the mechanical roping apparatus 100 is moved. Like the mechanical roping apparatus 70 shown in FIG. 7, the mechanical roping apparatus 100 shown in FIG. 10A includes two skids, skid 72*a* (shown) and another skid (not shown); the animal assembly 74, which has a front, a rear, and a frame 76, and to which the skids are attached or with which the skids are integral; the tow bar 14, which is attached to or integral with the animal assembly 74, and the leg members 28, which are attached to or integral with the animal assembly 74 with indicia as described elsewhere herein such as lights 30. The body 12 of the mechanical roping apparatus 70 may include, e.g., the body of the steer, removable and rotatable horns at the front of the animal assembly allowing for different horn sizes, shapes, and angles and optionally front legs (not depicted).

The switch 106 of the indicia actuation assembly 102 of the mechanical roping apparatus 100 is, e.g., the pulley system 20 that is shown in FIG. 5 and described herein. Like the pulley system 20 depicted in FIG. 5, the switch 106 includes a light switch 58 that is triggered by the quarter circle plate 56 rotating about a pivot 52, that is on a wheel 54. The wheel 54 is connected by a pulley (not shown) to the indicia wheel 104. The indicia in the hind leg or legs come on with hind leg or legs in the fully extended rear position and/or until the top of the hop with hind leg or legs straight down (perpendicular to the ground), at which point the indicia is reduced to zero or eliminated. For example, lights can be located on any part of the hind leg or legs or even the hip, anywhere on the mechanical roping steer apparatus, the horns, the wheels, the tow bar, or even the device pulling the mechanical roping steer apparatus. Generally, the lights will be located in a location that permits the user to best determine the optimal position of the hind leg or legs for roping, e.g., from hock to ankle of leg, the feet, on or about the lower, middle, upper portion of the hind leg or legs.

An embodiment of the present invention includes a method for practicing animal roping including providing a mechanical roping apparatus that includes an animal assembly, a leg assembly, one or more indicia, and an indicia actuation assembly, such as the exemplary mechanical roping apparatus 100 as shown and described herein. The method also includes practicing roping the animal assembly leg members.

FIG. 10B shows a mechanical roping apparatus 150 that is similar to the mechanical roping steer apparatus 10 that is shown in FIGS. 1-4 and 6 and described herein, except that the mechanical roping apparatus 150 includes one or more skids represented by skid 151*a* in FIG. 10B instead of the wheel or wheels 16 shown in FIGS. 1-4, and further, the pulley system 20, which is shown in FIG. 5 and described herein, is connected to a leg actuation wheel 154 by the belt 18. The mechanical roping apparatus 150 includes a leg actuation assembly 152, which includes the leg actuation wheel 154 rotatably mounted on the frame in contact with the ground and a linkage (e.g., arms 32 and 34) connecting the leg actuation wheel 154 to the leg assembly 28 including leg members 28 such that rotation of the leg actuation wheel 154 by the ground when the animal assembly 12 is moved over the ground surface is transferred to the leg assembly to pivot at least one of the leg members 28, wherein the leg actuation assembly 152 is configured to move the leg members 28 from a forward position when the leg members 28 touch the ground, during a stride such that the leg members 28 are in contact with the ground until they reach a rear facing position and the leg members are raised from the ground and kick; and the leg members 28 are off the ground from the rear facing position to the forward position.

Another embodiment of the invention includes a method for practicing animal roping including providing a mechanical roping apparatus that includes an animal assembly, a leg assembly, and a leg actuation assembly, such as the exemplary mechanical roping apparatus 150 as shown and described herein. The method also includes practicing roping the animal assembly leg members.

In embodiments of the present invention, a mechanical roping apparatus, e.g., the mechanical roping apparatuses 100 and 150, can have both the indicia actuation, assembly exemplified by the indicia actuation assembly 100, and the leg actuation assembly, exemplified by the leg actuation assembly 150. In embodiments including both the indicia actuation assembly and the leg actuation assembly, a single wheel can serve as an indicia wheel, exemplified by the indicia wheel 104, and a leg actuation wheel, exemplified by the leg actuation wheel 154.

Referring back to the arena float 90, shown in FIGS. 9A-9C and described herein, the arena float can be used with a variety of mechanical roping apparatuses, such as the exemplary mechanical roping apparatuses 10, 70, 95, 100, and 150 as shown and described herein.

It will be understood that any assembly, apparatus, component, element, method step, or other item disclosed herein can be combined with any other assembly, apparatus, component, element, method step, or other item disclosed herein unless such a combination is physically impossible. Such combinations are considered to be within the scope of this invention.

An embodiment of the present invention comprises, consists essentially of, or consists of a mechanical roping apparatus for practicing animal roping, the apparatus comprising: an animal assembly comprising a front, a rear, a frame, and a pivot that provides an up and down motion at the rear of the animal assembly to simulate a hopping motion by an animal; a leg assembly mounted at the rear of the frame and including leg members that are movable with respect to the frame to simulate a running motion; and an actuation assembly configured to move the leg members from a forward position when the leg members touch the ground, during a stride such that the leg members are in contact with the ground until they reach a rear facing position and the leg members are raised from the ground and kick; and the leg members are off the ground from the rear position to the front position.

Another embodiment of the present invention comprises, consists essentially of, or consists of a method for practicing animal roping comprising: providing a mechanical roping apparatus, the mechanical roping apparatus comprising: an animal assembly comprising: a front, a rear, a frame, and a pivot that provides an up and down motion at the rear of the frame to simulate a hopping motion by an animal; a leg assembly mounted at the rear of the frame and including one or more leg members that are movable with respect to the animal assembly to simulate a running motion; and an actuation assembly configured to move the leg members from a forward position when the leg members touch the ground, during a stride such that the leg members are in contact with the ground until they reach a rear facing position and the leg members are raised from the ground and kick; and the leg members are off the ground from the rear position to the front position; pulling the animal assembly to simulate the running motion of the animal; and operating the actuation assembly.

Another embodiment of the present invention comprises, consists essentially of, or consists of a mechanical roping apparatus for practicing roping of an steer, the apparatus comprising: a steer assembly comprising a front, a rear, a frame, and a pivot that provides an up and down motion at the rear of the steer assembly to simulate a hopping motion by a steer; a leg assembly mounted at the rear of the frame and including leg members that are movable with respect to the frame to simulate a running motion; an actuation assembly configured to move the leg members from a forward position when the leg members touch the ground, during a stride such that the leg members are in contact with the ground until they reach a rear facing position and the leg members are raised from the ground and kick; and the leg members are off the ground from the rear position to the front position; and a wheel assembly positioned at the front of the animal assembly in contact with the ground, and 2, 3, or 4 or more wheels are positioned to the right, left, or both of a longitudinal centerline of the steer assembly.

Another embodiment of the present invention comprises, consists essentially of, or consists of a mechanical roping apparatus for practicing animal roping, the apparatus comprising: a stand; a leg assembly mounted on the stand and including leg members that are movable with respect to the stand to simulate a running motion; and stand and including leg members that are movable with respect to the stand to simulate a running motion; and an actuation assembly configured to move the leg members from a forward position when the leg members touch the ground, during a stride such that the leg members are in contact with the ground until they reach a rear facing position and the leg members are raised from the ground and kick; and the leg members are off the ground from the rear position to the front position.

Another embodiment of the present invention comprises, consists essentially of, or consists of an animal assembly comprising a front, a rear, and a frame; a leg assembly mounted at the rear of the frame and including leg members; and 2, 3, or 4 or more wheels or skids positioned to the right, left, or both of a longitudinal centerline of the animal assembly.

Another embodiment of the present invention comprises, consists essentially of, or consists of a stand; and a leg assembly mounted on the stand and including leg members.

Another embodiment of the present invention comprises, consists essentially of, or consists of a method for practicing animal roping comprising: an animal assembly comprising a front, a rear, and a frame; a leg assembly mounted at the rear of the frame and including animal assembly leg members; and 2, 3, or 4 or more wheels or skids positioned to the right, left, or both of a longitudinal centerline of the animal assembly; or a stand and a leg assembly mounted on the stand and including stand leg members; and practicing roping the animal assembly leg members or the stand leg members.

Another embodiment of the present invention comprises, consists essentially of, or consists of a mechanical roping apparatus for practicing animal roping including an animal assembly including a front, a rear, and a frame; a leg assembly mounted at the rear of the animal assembly and including leg members; one or more indicia selected from a vibrational cue carried by a user, a visual cue, or an auditory cue, wherein the one or more indicia are configured to indicate to the user a proper time to rope a leg member using proper roping technique; two or more wheels or skids positioned to the right, left, or both of a longitudinal centerline of the animal assembly; and an arena float connected to the animal assembly, the arena float including a float connector connected to the animal assembly; a float arm rotatably connected to the float connector at a proximate end of the float arm such that the float arm is configured to rotate in a vertical plane, the float arm including one float arm segment or two or more float arm segments, wherein the two or more float arm segments are rotatably connected in sequence such that each of the two or more float arm segments are configured to rotate in the vertical plane; and a leveler connected to a distal end of the float arm and configured to condition material of an arena surface ahead of the wheels or the skids. In one aspect, the float connector is a tow bar. In another aspect, the float arm includes wood, metal, or a combination thereof. In another aspect, the one float arm segment or the two or more float arm segments are configured to be rotated and fixed in position to adjust a height of the leveler relative to the arena surface. In another aspect, the two or more float arm segments are configured to be rotated and fixed to adjust an angle of the leveler relative to the arena surface. In another aspect, the leveler includes wood, metal, or a combination thereof. In another aspect, the leveler includes a rake with a plurality of tines; a brush with a plurality of bristles, wires, or filaments; a blade; a smooth surface; a roughened surface; or a combination thereof. In another aspect, the leveler is connected rotatably to the float arm and configured to roll over the arena surface as the apparatus is moved on the arena surface. In another aspect, the apparatus further includes an indicia-actuation assembly including an indicia-actuation wheel rotatably mounted on the frame in contact with the ground, wherein the indicia-actuation wheel is configured to rotate as the apparatus is moved over the ground; an indicia-actuation pulley system including a pivot and quarter-circle plate rotatably mounted on the pivot and connected to the indicia-actuation wheel, wherein the quarter-circle plate is configured to rotate as the indicia-actuation wheel rotates; and an indicia-actuation switch connected to the quarter-circle plate and to the one or more indicia and configured to operate the one or more indicia as the quarter-circle plate rotates.

Another embodiment of the present invention comprises, consists essentially of, or consists of a leveler kit including an arena float configured to be connected to a mechanical roping apparatus, the arena float including a float arm rotatably connected to the float connector at a proximate end of the float arm such that the float arm is configured to rotate in a vertical plane, the float arm including one float arm segment or two or more float arm segments, wherein the two or more float arm segments are configured to be rotatably connected in sequence such that each of the two or more float arm segments are configured to rotate in the vertical plane; and a leveler configured to be connected to a distal end of the float arm and configured to condition material of an arena surface ahead of the wheels or the skids; and one or more fasteners configured to connect the float arm to a float connector of a mechanical roping apparatus, to connect the two or more float arm segments in sequence, or to connect the leveler to the float arm. In one aspect, the float arm includes wood, metal, or a combination thereof. In another aspect, the one float arm segment or the two or more float arm segments are configured to be rotated and fixed in position to adjust a height of the leveler relative to the arena surface. In another aspect, the two or more float arm segments are configured to be rotated and fixed to adjust an angle of the leveler relative to the arena surface. In another aspect, the leveler includes wood, metal, or a combination thereof. In another aspect, the leveler includes a rake with a plurality of tines; a brush with a plurality of bristles, wires, or filaments; a blade; a smooth surface; a roughened surface; or a combination thereof. In another aspect, the leveler is connected rotatably to the float arm and configured to roll over the arena surface as the apparatus is moved on the arena surface. In another aspect, the kit further includes the float connector, wherein the float connector is configured to be connected to the mechanical roping apparatus and to the proximate end of the float arm.

Another embodiment of the present invention comprises, consists essentially of, or consists of a method of conditioning an arena surface for a mechanical roping apparatus, the method including providing the a mechanical roping apparatus for practicing animal roping including an animal assembly including a front, a rear, and a frame; a leg assembly mounted at the rear of the animal assembly—and including leg members; one or more indicia selected from a vibrational cue carried by a user, a visual cue, or an auditory cue, wherein the one or more indicia are configured to indicate to the user a proper time to rope a leg member using proper roping technique; two or more wheels or skids positioned to the right, left, or both of a longitudinal centerline of the animal assembly; providing an arena float connected to the animal assembly, the arena float including a float connector connected to the animal assembly; a float arm rotatably connected to the float connector at a proximate end of the float arm such that the float arm is configured to rotate in a vertical plane, the float arm including one float arm segment or two or more float arm segments, wherein the two or more float arm segments are rotatably connected in sequence such that each of the two or more float arm segments are configured to rotate in the vertical plane; and a leveler connected to a distal end of the float arm and configured to condition material of an arena surface ahead of the wheels or the skids; connecting the arena float to the mechanical roping apparatus; adjusting the height, angle, or both of the leveler relative to the arena surface to contact the arena surface; and moving the mechanical roping apparatus on the arena surface, thereby conditioning the arena surface with the leveler. In one aspect, the float connector is a tow bar. In another aspect, the float arm includes wood, metal, or a combination thereof. In another aspect, the one float arm segment or the two or more float arm segments are configured to be rotated and fixed in position to adjust a height of the leveler relative to the arena surface. In another aspect, the two or more float arm segments are configured to be rotated and fixed to adjust an angle of the leveler relative to the arena surface. In another aspect, the leveler includes wood, metal, or a combination thereof. In another aspect, the leveler includes a rake with a plurality of tines; a brush with a plurality of bristles, wires, or filaments; a blade; a smooth surface; a roughened surface; or a combination thereof. In another aspect, the leveler is connected rotatably to the float arm and configured to roll over the arena surface as the apparatus is moved on the arena surface.

Another embodiment of the present invention comprises, consists essentially of, or consists of a mechanical roping apparatus for practicing animal roping including an animal assembly including a front, a rear, and a frame; a leg assembly mounted at the rear of the animal assembly and including leg members; one or more indicia selected from a vibrational cue carried by a user, a visual cue, or an auditory cue, wherein the one or more indicia are configured to indicate to the user a proper time to rope a leg member using proper roping technique; two or more wheels or skids positioned to the right, left, or both of a longitudinal centerline of the animal assembly; and an indicia-actuation assembly including an indicia-actuation wheel rotatably mounted on the frame in contact with the ground, wherein the indicia-actuation wheel is configured to rotate as the apparatus is moved over the ground; an indicia-actuation pulley system including a pivot and quarter-circle plate rotatably mounted on the pivot and connected to the indicia-actuation wheel, wherein the quarter-circle plate is configured to rotate as the indicia-actuation wheel rotates; and an indicia-actuation switch connected to the quarter-circle plate and to the one or more indicia and configured to operate the one or more indicia as the quarter-circle plate rotates.

Another embodiment of the present invention comprises, consists essentially of, or consists of a mechanical roping apparatus for practicing animal roping, the apparatus including an animal assembly including a front, a rear, and a frame; a leg assembly mounted at the rear of the animal assembly and including leg members; one or more indicia mounted on the leg members, wherein the one or more indicia are a visual cue configured to indicate to a user a proper time to rope a leg member using proper roping technique, wherein the visual cue is selected from a light that changes colors, a light that traverses between a top to a bottom of a string of lights, lights that are red and green, or a light that dims and intensifies; an indicia actuation assembly including an indicia wheel rotatably mounted on the frame in contact with the ground; an indicia switch connected to the indicia wheel and to the one or more indicia and configured to operate the one or more indicia, wherein the switch is configured to operate as the indicia wheel turns when the animal assembly is moved; and two, three, or four or more skids positioned to the right, left, or both of a longitudinal centerline of the animal assembly. In one aspect, the animal assembly further includes a first pivot positioned on the frame between a front and a rear of the frame and around which the frame rotates, and a second pivot positioned on the frame at the front of the frame and around which the frame rotates, so that the rear of the animal assembly moves up and down as the frame rotates at least around the first pivot and the second pivot to simulate a hopping motion by an animal; and a leg actuation assembly including a leg actuation wheel rotatably mounted on the frame in contact with the ground; and a linkage connecting the leg actuation wheel to the leg assembly such that rotation of the leg actuation wheel by the ground is transferred to the leg assembly to pivot at least one of the leg members when the animal assembly is moved over the ground surface; wherein the leg actuation assembly is configured to move the leg members from a forward position when the leg members touch the ground, during a stride such that the leg members are in contact with the ground until they reach a rear facing position and the leg members are raised from the ground and kick; and the leg members are off the ground from the rear facing position to the forward position. In another aspect, the visual cue is selected from a light, a colored light, an LED, or an OLED. In another aspect, the apparatus further includes one or more lights to provide a focal point. In another aspect, the animal assembly further includes a body with removable and rotatable horns at the front of the animal assembly allowing for different horn sizes, shapes, and angles; or wherein the apparatus is configured to be pulled from a tow bar; or wherein the animal assembly simulates an animal that is bovine, ovine, equine, or swine.

Another embodiment of the present invention comprises, consists essentially of, or consists of a method for practicing animal roping including providing a mechanical roping apparatus including an animal assembly including a front, a rear, and a frame; a leg assembly mounted at the rear of the animal assembly and including leg members; one or more indicia mounted on the leg members, wherein the one or more indicia are a visual cue configured to indicate to a user a proper time to rope a leg member using proper roping technique, wherein the visual cue is selected from a light that changes colors, a light that traverses between a top to a bottom of a string of lights, lights that are red and green, or a light that dims and intensifies; an indicia actuation assembly including an indicia wheel rotatably mounted on the frame in contact with the ground; and practicing roping the leg members. In one aspect, the animal assembly further includes a first pivot positioned on the frame between a front and a rear of the frame and around which the frame rotates, and a second pivot positioned on the frame at the front of the frame and around which the frame rotates, so that the rear of the animal assembly moves up and down as the frame rotates at least around the first pivot and the second pivot to simulate a hopping motion by an animal; and a leg actuation assembly including a leg actuation wheel rotatably mounted on the frame in contact with the ground; a linkage connecting the leg actuation wheel to the leg assembly such that rotation of the leg actuation wheel by the ground is transferred to the leg assembly to pivot at least one of the leg members when the animal assembly is moved over the ground surface; wherein the leg actuation assembly is configured to move the leg members from a forward position when the leg members touch the ground, during a stride such that the leg members are in contact with the ground until they reach a rear facing position and the leg members are raised from the ground and kick; and the leg members are off the ground from the rear facing position to the forward position. In another aspect, the visual cue is selected from a light, a colored light, an LED, or an OLED. In another aspect, the apparatus further includes one or more lights to provide a focal point. In another aspect, wherein the animal assembly further includes removable and rotatable horns at the front of the animal assembly allowing for different horn sizes, shapes, and angles; or wherein the animal assembly simulates an animal that is bovine, ovine, equine, or swine.

Another embodiment of the present invention comprises, consists essentially of, or consists of a mechanical roping apparatus for practicing animal roping including an animal assembly including a front, a rear, and a frame; a leg assembly mounted at the rear of the animal assembly and including leg members; one or more indicia including a visual cue, wherein the one or more indicia are configured to indicate to a user a proper time to rope a leg member using proper roping technique; two or more wheels or skids positioned to the right, left, or both of a longitudinal centerline of the animal assembly; and an arena float connected to the animal assembly, the arena float including a float connector connected to the animal assembly; a float arm rotatably connected to the float connector at a proximate end of the float arm such that the float arm is configured to rotate in a vertical plane, the float arm including one float arm segment or two or more float arm segments, wherein the two or more float arm segments are rotatably connected in sequence such that each of the two or more float arm segments are configured to rotate in the vertical plane; and a leveler connected to a distal end of the float arm and configured to condition material of an arena surface ahead of the wheels or the skids. In one aspect, the float connector is a tow bar. In another aspect, the float arm includes wood, metal, or a combination thereof. In another aspect, the one float arm segment or the two or more float arm segments are configured to be rotated and fixed in position to adjust a height of the leveler relative to the arena surface. In another aspect, the two or more float arm segments are configured to be rotated and fixed to adjust an angle of the leveler relative to the arena surface. In another aspect, the leveler includes wood, metal, or a combination thereof. In another aspect, the leveler includes a rake with a plurality of tines; a brush with a plurality of bristles, wires, or filaments; a blade; a smooth surface; a roughened surface; or a combination thereof. In another aspect, the leveler is connected rotatably to the float arm and configured to roll over the arena surface as the apparatus is moved on the arena surface. In another aspect, the apparatus further includes an indicia-actuation wheel rotatably mounted on the frame in contact with the ground, wherein the indicia-actuation wheel is configured to rotate as the apparatus is moved over the ground; an indicia-actuation pulley system including a pivot and quarter-circle plate rotatably mounted on the pivot and connected to the indicia-actuation wheel, wherein the quarter-circle plate is configured to rotate as the indicia-actuation wheel rotates; and an indicia-actuation switch connected to the quarter-circle plate and to the one or more indicia and configured to operate the one or more indicia as the quarter-circle plate rotates.

Another embodiment of the present invention comprises, consists essentially of, or consists of a leveler kit including an arena float configured to be connected to a mechanical roping apparatus, the arena float including a float arm configured to be rotatably connected to a float connector at a proximate end of the float arm such that the float arm is configured to rotate in a vertical plane, the float arm including one float arm segment or two or more float arm segments, wherein the two or more float arm segments are configured to be rotatably connected in sequence such that each of the two or more float arm segments are configured to rotate in the vertical plane; and a leveler configured to be connected to a distal end of the float arm and configured to condition material of an arena surface ahead of wheels or skids; and; and one or more fasteners configured to connect the float arm to a float connector of a mechanical roping apparatus, to connect the two or more float arm segments in sequence, or to connect the leveler to the float arm. In one aspect, the leveler includes a rake with a plurality of tines; a brush with a plurality of bristles, wires, or filaments; a blade; or a roughened surface. In another aspect, the leveler is connected rotatably to the float arm and configured to roll over the arena surface as the apparatus is moved on the arena surface.

Another embodiment of the present invention comprises, consists essentially of, or consists of a method of conditioning an arena surface for a mechanical roping apparatus, the method including providing the mechanical roping apparatus including an animal assembly including a front, a rear, and a frame; a leg assembly mounted at the rear of the animal assembly—and including leg members; one or more indicia including a visual cue, wherein the one or more indicia are configured to indicate to a user a proper time to rope a leg member using proper roping technique; and two or more wheels or skids positioned to the right, left, or both of a longitudinal centerline of the animal assembly; providing an arena float including a float connector connected to the animal assembly; a float arm rotatably connected to the float connector at a proximate end of the float arm such that the float arm is configured to rotate in a vertical plane, the float arm including one float arm segment or two or more float arm segments, wherein the two or more float arm segments are rotatably connected in sequence such that each of the two or more float arm segments are configured to rotate in the vertical plane; and a leveler connected to a distal end of the float arm and configured to condition material of an arena surface ahead of the wheels or the skids; connecting the arena float to the mechanical roping apparatus; adjusting the height, angle, or both of the leveler relative to the arena surface to contact the arena surface; and moving the mechanical roping apparatus on the arena surface, thereby conditioning the arena surface with the leveler.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic(s), propertie(s), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12 or 15%.

All of the apparatuses and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A mechanical roping apparatus for practicing animal roping, the apparatus comprising:

an animal assembly comprising a front, a rear, and a frame;

a leg assembly mounted at the rear of the animal assembly and including leg members;

one or more indicia mounted on the leg members, wherein the one or more indicia are a visual cue configured to indicate to a user a proper time to rope a leg member using proper roping technique, wherein the visual cue is selected from a light that changes colors, a light that traverses between a top to a bottom of a string of lights, lights that are red and green, or a light that dims and intensifies;

an indicia actuation assembly comprising:

an indicia wheel rotatably mounted on the frame in contact with the ground; and an indicia switch connected to the indicia wheel and to the one or more indicia and configured to operate the one or more indicia, wherein the switch is configured to operate as the indicia wheel turns when the animal assembly is moved; and two, three, four or more skids positioned to the right, left, or both of a longitudinal centerline of the animal assembly.

2. The apparatus of claim 1, wherein the animal assembly further comprises a first pivot positioned on the frame between a front and a rear of the frame and around which the frame rotates, and a second pivot positioned on the frame at the front of the frame and around which the frame rotates, so that the rear of the animal assembly moves up and down as the frame rotates at least around the first pivot and the second pivot to simulate a hopping motion by an animal; and a leg actuation assembly comprising:

a leg actuation wheel rotatably mounted on the frame in contact with the ground;

a linkage connecting the leg actuation wheel to the leg assembly such that rotation of the leg actuation wheel by the ground is transferred to the leg assembly to pivot at least one of the leg members when the animal assembly is moved over the ground surface;

wherein the leg actuation assembly is configured to move the leg members from a forward position when the leg members touch the ground, during a stride such that the leg members are in contact with the ground until they reach a rear facing position and the leg members are raised from the ground and kick; and the leg members are off the ground from the rear facing position to the forward position.

3. The apparatus of claim 1, wherein the visual cue is selected from a colored light, an LED, or an OLED.

4. The apparatus of claim 1, further comprising one or more lights to provide a focal point.

5. The apparatus of claim 1, wherein the animal assembly further comprises a body with removable and rotatable horns at the front of the animal assembly allowing for different horn sizes, shapes, and angles; or wherein the apparatus is configured to be pulled from a tow bar; or wherein the animal assembly simulates an animal that is bovine, ovine, equine, or swine.

6. A method for practicing animal roping comprising:

providing a mechanical roping apparatus comprising:

an animal assembly comprising a front, a rear, and a frame;

a leg assembly mounted at the rear of the animal assembly and including leg members;

one or more indicia mounted on the leg members, wherein the one or more indicia are a visual cue configured to indicate to a user a proper time to rope a leg member using proper roping technique, wherein the visual cue is selected from a light that changes colors, a light that traverses between a top to a bottom of a string of lights, lights that are red and green, or a light that dims and intensifies; and an indicia actuation assembly comprising:

an indicia wheel rotatably mounted on the frame in contact with the ground; and an indicia switch connected to the indicia wheel and to the one or more indicia and configured to operate the one or more indicia, wherein the switch is configured to operate as the indicia wheel turns when the mechanical roping apparatus is moved; and practicing roping the leg members.

7. The method of claim 6, wherein the animal assembly further comprises a first pivot positioned on the frame between a front and a rear of the frame and around which the frame rotates, and a second pivot positioned on the frame at the front of the frame and around which the frame rotates, so that the rear of the animal assembly moves up and down as the frame rotates at least around the first pivot and the second pivot to simulate a hopping motion by an animal; and a leg actuation assembly comprising a leg actuation wheel rotatably mounted on the frame in contact with the ground;

a linkage connecting the leg actuation wheel to the leg assembly such that rotation of the wheel by the ground is transferred to the leg assembly to pivot at least one of the leg members when the animal assembly is moved over the ground surface;

wherein the leg actuation assembly is configured to move the leg members from a forward position when the leg members touch the ground, during a stride such that the leg members are in contact with the ground until they reach a rear facing position and the leg members are raised from the ground and kick; and the leg members are off the ground from the rear facing position to the forward position.

8. The method of claim 6, wherein the visual cue is selected from a colored light, an LED, or an OLED.

9. The method of claim 6, further comprising one or more lights to provide a focal point.

10. The method of claim 6, wherein the animal assembly further comprises removable and rotatable horns at the front of the animal assembly allowing for different horn sizes, shapes, and angles; or wherein the animal assembly simulates an animal that is bovine, ovine, equine, or swine.

11. A mechanical roping apparatus for practicing animal roping comprising:

an animal assembly comprising a front, a rear, and a frame;

a leg assembly mounted at the rear of the animal assembly and including leg members;

one or more indicia comprising a visual cue, wherein the one or more indicia are configured to indicate to a user a proper time to rope a leg member using proper roping technique;

an indicia actuation assembly comprising:

an indicia wheel rotatably mounted on the frame in contact with the ground; and an indicia switch connected to the indicia wheel and to the one or more indicia and configured to operate the one or more indicia, wherein the switch is configured to operate as the indicia wheel turns when the animal assembly is moved;

two or more wheels or skids positioned to the right, left, or both of a longitudinal centerline of the animal assembly; and an arena float connected to the animal assembly, the arena float comprising:

a float connector connected to the animal assembly;

a float arm rotatably connected to the float connector at a proximate end of the float arm such that the float arm is configured to rotate in a vertical plane, the float arm comprising one float arm segment or two or more float arm segments, wherein the two or more float arm segments are rotatably connected in sequence such that each of the two or more float arm segments are configured to rotate in the vertical plane; and a leveler connected to a distal end of the float arm and configured to condition material of an arena surface ahead of the wheels or the skids.

12. The apparatus of claim 11, wherein the float connector is a tow bar.

13. The apparatus of claim 11, wherein the float arm comprises wood, metal, or a combination thereof.

14. The apparatus of claim 11, wherein the one float arm segment or the two or more float arm segments are configured to be rotated and fixed in position to adjust a height of the leveler relative to the arena surface.

15. The apparatus of claim 11, wherein the two or more float arm segments are configured to be rotated and fixed to adjust an angle of the leveler relative to the arena surface.

16. The apparatus of claim 11, wherein the leveler comprises wood, metal, or a combination thereof.

17. The apparatus of claim 11, wherein the leveler comprises:

a rake with a plurality of tines, a brush with a plurality of bristles, wires, or filaments, a blade, a smooth surface, a roughened surface, or a combination thereof.

18. The apparatus of claim 11, wherein the leveler is connected rotatably to the float arm and configured to roll over the arena surface as the apparatus is moved on the arena surface.

19. The apparatus of claim 11, the indicia assembly further comprising:

an indicia pulley system comprising a pivot and quarter-circle plate rotatably mounted on the pivot and connected to the indicia wheel, wherein the quarter-circle plate is configured to rotate as the indicia wheel rotates; and the indicia switch connected to the quarter-circle plate and to the one or more indicia and configured to operate the one or more indicia as the quarter-circle plate rotates.

20. A method of conditioning an arena surface for a mechanical roping apparatus, the method comprising:

providing the mechanical roping apparatus comprising:

an animal assembly comprising a front, a rear, and a frame;

a leg assembly mounted at the rear of the animal assembly and including leg members;

one or more indicia comprising a visual cue, wherein the one or more indicia are configured to indicate to a user a proper time to rope a leg member using proper roping technique; and an indicia actuation assembly comprising:

an indicia wheel rotatably mounted on the frame in contact with the ground; and an indicia switch connected to the indicia wheel and to the one or more indicia and configured to operate the one or more indicia, wherein the switch is configured to operate as the indicia wheel turns when the animal assembly is moved;

two or more wheels or skids positioned to the right, left, or both of a longitudinal centerline of the animal assembly;

providing an arena float comprising:

a float connector connected to the animal assembly;

a float arm rotatably connected to the float connector at a proximate end of the float arm such that the float arm is configured to rotate in a vertical plane, the float arm comprising one float arm segment or two or more float arm segments, wherein the two or more float arm segments are rotatably connected in sequence such that each of the two or more float arm segments are configured to rotate in the vertical plane; and a leveler connected to a distal end of the float arm and configured to condition material of an arena surface ahead of the wheels or the skids;

connecting the arena float to the mechanical roping apparatus;

adjusting the height, angle, or both, of the leveler relative to the arena surface to contact the arena surface; and moving the mechanical roping apparatus on the arena surface, thereby conditioning the arena surface with the leveler.

* * * * *